US010189261B2

(12) United States Patent
Muto

(10) Patent No.: US 10,189,261 B2
(45) Date of Patent: Jan. 29, 2019

(54) LIQUID DISCHARGE APPARATUS AND METHOD FOR WIPING LIQUID DISCHARGE HEAD

(71) Applicant: Seiko Epson Corporation, Tokyo (JP)

(72) Inventor: Atsushi Muto, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/386,330

(22) Filed: Dec. 21, 2016

(65) Prior Publication Data

US 2017/0197418 A1 Jul. 13, 2017

(30) Foreign Application Priority Data

Jan. 13, 2016 (JP) ..... 2016-004163

(51) Int. Cl.
*B41J 2/165* (2006.01)

(52) U.S. Cl.
CPC ..... *B41J 2/16544* (2013.01); *B41J 2/16535* (2013.01)

(58) Field of Classification Search
CPC .. B41J 2/16544; B41J 2/1714; B41J 2/16517; B41J 2/16535; B41J 2/16547; B41J 2002/1655
See application file for complete search history.

(56) References Cited

U.S. PATENT DOCUMENTS

2006/0066665 A1 3/2006 Kachi et al.
2010/0026757 A1 2/2010 Kawamoto et al.
2012/0038706 A1 2/2012 Izawa et al.
2014/0184675 A1* 7/2014 Tamaki ..... B41J 2/14233 347/9
2014/0253633 A1 9/2014 Kobayashi et al.

FOREIGN PATENT DOCUMENTS

EP 1 870 241 A1 12/2007
JP 2003-127403 A 5/2003
JP 2006-095881 A 4/2006
JP 2012-035563 A 2/2012

OTHER PUBLICATIONS

Extended European Search Report for Application No. EP 17 15 1387 dated Aug. 2, 2017 (7 pages).

* cited by examiner

*Primary Examiner* — Thinh H Nguyen

(74) *Attorney, Agent, or Firm* — Harness, Dickey & Pierce, P.L.C.

(57) ABSTRACT

A liquid discharge apparatus includes: a wiper; a wiping surface for wiped with the wiper; a plurality of nozzles provided in the wiping surface; a piezoelectric element for discharging inks from the nozzles; and a carriage unit and a cleaning unit configured to cause the wiper and the wiping surface to relatively move. In a moving direction of the wiper with respect to the wiping surface, a distance between a side of the wiping surface on an upstream side in the moving direction and the nozzle disposed on the most upstream side is shorter than a distance between a side of the wiping surface on a downstream side in the moving direction and the nozzle disposed on the most downstream side.

9 Claims, 14 Drawing Sheets

LIQUID DISCHARGE APPARATUS AND METHOD FOR WIPING LIQUID DISCHARGE HEAD

BACKGROUND

1. Technical Field

The present invention relates to a liquid discharge apparatus and a method for wiping a liquid discharge head mounted in the liquid discharge apparatus.

2. Related Art

As a liquid discharge apparatus that discharges a liquid to a recording medium, an ink jet type recording apparatus that discharges an ink as the liquid and performs printing on the recording medium such as paper or a recording sheet has been known.

Since an ink jet type recording head mounted in such an ink jet type recording apparatus discharges an ink as ink droplets from a nozzle, the ink is attached to the vicinity of the nozzle. Further, when viscosity of the attached ink is increased, there is a problem in that a discharge direction of ink droplets becomes unstable or a problem in that it is difficult to appropriately discharge ink droplets.

Therefore, cleaning by wiping, with a wiper, a nozzle surface, in which the nozzles of the ink jet type recording head are provided, is proposed (for example, JP-A-2012-035563).

In an ink jet type recording apparatus disclosed in JP-A-2012-035563, nozzle surfaces of a plurality of nozzle heads arranged in a line head are wiped with a wiper.

Specifically, a side of the line head, on which the nozzle surfaces are arranged, has a region in which the nozzle heads are arranged and a region in which no nozzle heads are arranged. The wiper is lifted and comes into contact with the line head, or is lowered and is separated from the line head. When the wiper approaches a region in which the nozzle heads are arranged, the wiper is lifted, comes into contact with the nozzle surface of the line head, and wipes the nozzle surface. When the wiper recedes from the region in which the nozzle heads are arranged, the wiper is lowered and separated from the nozzle surface of the line head. Therefore, the wiper does not wipe the entire line head, but wipes the region in which the nozzle heads (nozzle surfaces) are arranged. Thus, the wiper is prevented from being abraded or chipped early and an occurrence of stain on the periphery of the line head through a wiping operation is prevented, compared to a case where the wiper wipes the entire line head.

The ink discharged from the nozzle surface floats as mist and is attached to the region in which the nozzle heads are arranged or the region in which no nozzle heads are arranged. In a method for wiping disclosed in JP-A-2012-035563, the ink attached to the region, in which the nozzles are arranged, is removed, but the ink attached to the region, in which no nozzles are arranged, is not removed. Therefore, the ink (stain) remains in the region in which no nozzles are arranged. For example, there is a concern that the stain remaining in the region, in which no nozzles are arranged, will fall on a recording medium at an unexpected timing and the recording medium is stained. In addition, there is also another concern that the stains will be accumulated in the region in which no nozzles are arranged and the recording medium will come into contact with the accumulated stains and will be stained.

In other words, there is a concern that, since stains remain on a part of the line head on the side on which the nozzle surfaces are arranged (the region in which no nozzles are arranged), the recording medium will be stained and the print quality will be degraded.

SUMMARY

The invention can be realized in the following aspects or application examples.

Application Example 1

According to this application example, there is provided a liquid discharge apparatus including: a wiper; a wiping surface that is wiped with the wiper; a plurality of nozzles provided in the wiping surface; a drive element that causes liquids to be discharged from the nozzles; and a moving mechanism that causes the wiper and the wiping surface to relatively move. In a moving direction of the wiper with respect to the wiping surface, a distance between an edge of the wiping surface on an upstream side in the moving direction and the nozzle disposed on the upstream side is shorter than a distance between an edge of the wiping surface on a downstream side in the moving direction and the nozzle disposed on the downstream side.

The liquids discharged from the nozzles float as mist and are attached to the wiping surface as stains. Further, foreign substances such as lint or dust are attached to the wiping surface and are mixed in the stains.

In a case where the nozzles are arranged to be closer to one side (asymmetrical) with respect to the wiping surface, a distance between an edge of the wiping surface and the nozzle is not uniform, and there are a portion having a long distance between the edge of the wiping surface and the nozzle and a portion having short distance between the edge of the wiping surface and the nozzle. Since the stains are attached substantially evenly to the wiping surface, a large number of the stains are attached in the portion having the long distance between the edge of the wiping surface and the nozzle and a small number of the stains are attached in the portion having the short distance between the edge of the wiping surface and the nozzle.

For example, when the wiping is performed on the wiping surface by causing the wiper to move from the portion having a large number of attachment of the stains toward the portion having a small number of attachment of the stains, a large amount of the stains (foreign substances) moves along with the wiper, the foreign substances are rubbed into the inside of the nozzles, and there is a concern that a problem of degradation of an ink discharge performance of the nozzles will arise. When the wiper is caused to move from the portion having a small number of attachment of the stains toward the portion having a large number of attachment of the stains, a small amount of the stains (foreign substances) moves along with the wiper, the foreign substances are unlikely to be rubbed into the inside of the nozzles, and a problem of the degradation of the ink discharge performance of the nozzles is unlikely to arise, compared to a case where the wiper is caused to move from the portion having a large number of attachment of the stains toward the portion having a small number of attachment of the stains.

When the wiper is caused to move from the portion having a small number of attachment of the stains toward the portion having a large number of attachment of the stains, the wiper is caused to move in a state in which the distance between the edge of the wiping surface and the nozzle on the upstream side in the moving direction of the wiper is shorter than the distance between the edge of the wiping surface and the nozzle on the downstream side in the moving direction of the wiper. Therefore, according to this application example, it is possible to reduce an occurrence of the problem arising in that foreign substances are rubbed into the inside of the nozzles and the ink discharge performance of the nozzles is degraded.

Further, since not only stains attached in the region, in which the nozzles are arranged, are removed, but also stains attached between the edge of the wiping surface and the nozzle (a region in which no nozzles are arranged) are removed, it is possible to lower the concern that stains will remain in the region in which no nozzles are arranged, a recording medium will be stained with the stains, and the print quality will be degraded.

Application Example 2

In the liquid discharge apparatus according to the application example, it is preferable that the liquid contain a humectant, and the wiper wipe a nozzle that discharges a liquid having a low humectant content rate of the liquids, and then wipe a nozzle that discharges a liquid having a high humectant content rate of the liquids.

The humectant has hygroscopicity, reduces evaporation of an aqueous solvent component in the liquid, and reduces a change in the properties of the liquid.

In a case where, due to a residue of the liquid, a liquid having a high humectant content rate is positioned in the vicinity of a nozzle that discharges a liquid having a low humectant content rate, there occurs a phenomenon in which the aqueous solvent component in the liquid having the low humectant content rate moves into the liquid having the high humectant content rate. As a result, the concentration of the aqueous solvent component in the liquid having the low humectant content rate changes. Therefore, the concentrations of the aqueous solvent component in the liquid having the low humectant content rate are different between the region in which the residue of the liquid occurs from the wiping and the region in which the residue of the liquid does not occur from the wiping, and it is difficult to evenly discharge the liquid having the low humectant content rate from the nozzles.

On the other hand, in a case where, due to a residue of the liquid, a liquid having the low humectant content rate is positioned in the vicinity of a nozzle that discharges a liquid having the high humectant content rate, there occurs no phenomenon in which the aqueous solvent component in the liquid having the high humectant content rate moves into the liquid having the low humectant content rate. Therefore, since the concentrations of the aqueous solvent components in the liquids having the high humectant content rate are the same in the region in which the residue of the liquid occurs from the wiping and the region in which the residue of the liquid does not occur from the wiping, it is possible to evenly discharge the liquid having the high humectant content rate from the nozzles, and it is possible to reduce an occurrence of a problem arising in that it is difficult to evenly discharge the liquids described above from the nozzles.

Hence, when the nozzles that discharge the liquid having the low humectant content rate are wiped, and then the nozzles that discharge the liquid having the high humectant content rate are wiped, the liquid having the low humectant content rate is positioned in the vicinity of the nozzle that discharges the liquid having the high humectant content rate, but the liquid having the high humectant content rate is not positioned in the vicinity of the nozzle that discharges the liquid having the low humectant content rate, due to the residue of the liquid. Therefore, it is possible to reduce an occurrence of a problem arising in that it is difficult to evenly discharge the liquids from the nozzles.

Application Example 3

In the liquid discharge apparatus according to the application example, it is preferable that the wiper be shorter in length in a direction intersecting with the moving direction of the wiper than the wiping surface in the direction intersecting with the moving direction, and the wiper relatively move a plurality of times from the edge of the wiping surface on the upstream side to the edge of the wiping surface on the downstream side, thereby wiping the wiping surface.

For example, when the liquids that are discharged from the nozzles have different properties, appropriate conditions of wiping processes vary depending on the properties of the liquids, and there are regions in the wiping surface in which the conditions of the wiping processes vary. In the direction intersecting with the moving direction of the wiper, the length of the wiper is shorter than the length of the wiping surface. When the wiping surface is divided into a plurality of regions and the wiping is performed, it is possible to wipe the regions having different appropriate conditions of the wiping processes with the appropriate conditions of the wiping processes.

Application Example 4

In the liquid discharge apparatus according to the application example, it is preferable that the wiping surface have a plurality of nozzle plates in which the nozzles are formed, the nozzle plates be arranged in a zigzag pattern, and the nozzle plates be arranged at positions which are closer to the edge of the wiping surface on the upstream side than the edge on the downstream side, in the moving direction.

Since the nozzle plates are arranged in a zigzag pattern on the wiping surface (arranged to be closer to one side), there are a portion having a long distance between the edge of the wiping surface and the nozzle plate and a portion having short distance between the edge of the wiping surface and the nozzle plate. When the wiper is caused to move in a state in which the distance between the edge of the wiping surface and the nozzle plate on the upstream side in the moving direction of the wiper is shorter than the distance between the edge of the wiping surface and the nozzle plate on the downstream side in the moving direction of the wiper, the wiper is caused to move from the portion having a small number of attachment of the stains toward the portion having a large number of attachment of the stains. Therefore, a small amount of stains (foreign substances) moves along with the wiper, the foreign substances are unlikely to be rubbed into the inside of the nozzles, and thus it is possible to reduce an occurrence of the problem arising in that the ink discharge performance of the nozzles is degraded.

Application Example 5

In the liquid discharge apparatus according to the application example, it is preferable that the wiping surface have a first nozzle plate and a second nozzle plate in which the nozzles are formed, and the wiper include a first wiper that wipes the first nozzle plate and a second wiper that wipes the second nozzle plate.

When the first wiper wipes the first nozzle plate and the second wiper wipes the second nozzle plate, it is possible to perform appropriate wiping processes on the first nozzle plate and the second nozzle plate, respectively, compared to a case where one wiper simultaneously (collectively) wipes the first nozzle plate and the second nozzle plate.

Application Example 6

In the liquid discharge apparatus according to the application example, it is preferable that the wiping surface have a first nozzle plate and a second nozzle plate in which the nozzles are formed, and the wiper wipe the first nozzle plate, and then wipe the second nozzle plate.

When the wiper wipes the first nozzle plate, and then wipes the second nozzle plate, it is possible to perform appropriate wiping processes on the first nozzle plate and the second nozzle plate, respectively, compared to a case where the wiper simultaneously (collectively) wipes the first nozzle plate and the second nozzle plate.

Application Example 7

In the liquid discharge apparatus according to the application example, it is preferable that the wiping surface have a nozzle plate group including a first nozzle plate and a second nozzle plate in which the nozzles are formed and which are arranged in the moving direction, the nozzle plate group be disposed at a position which is closer to the edge of the wiping surface on the upstream side than the edge on the downstream side, in the moving direction, and the wiper wipe the nozzle plate group in the moving direction.

Since the first nozzle plate and the second nozzle plate are arranged in the moving direction of the wiper, the wiper can continually wipe the first nozzle plate and the second nozzle plate and it is efficient to perform the wiping process.

Further, Since the nozzle plate group is disposed to be closer to one side of the wiping surface, there are a portion having a long distance between the edge of the wiping surface and the nozzle plate group and a portion having short distance between the edge of the wiping surface and the nozzle plate group. When the wiper is caused to move in a state in which the distance between the edge of the wiping surface and the nozzle plate group on the upstream side in the moving direction of the wiper is shorter than the distance between the edge of the wiping surface and the nozzle plate group on the downstream side in the moving direction of the wiper, the wiper is caused to move from the portion having a small number of attachment of the stains toward the portion having a large number of attachment of the stains. Therefore, a small amount of stains (foreign substances) moves along with the wiper, the foreign substances are unlikely to be rubbed into the inside of the nozzles, and thus it is possible to reduce an occurrence of the problem arising in that the ink discharge performance of the nozzles is degraded.

Application Example 8

In the liquid discharge apparatus according to the application example, it is preferable that the wiping surface have a nozzle plate in which nozzles that discharge a liquid having a high viscosity of the liquids are formed and a nozzle plate in which nozzles that discharge a liquid having a low viscosity of the liquids are formed, and the wiper move with respect to the wiping surface at a slower speed on the nozzle plate in which the nozzles that discharge the liquid having the high viscosity of the liquids are formed than on the nozzle plate in which nozzles that discharge the liquid having the low viscosity of the liquids are formed.

Since the liquid having the high viscosity is more difficult to flow than the liquid having the low viscosity, the liquid having the high viscosity that is attached to the wiping surface is more difficult to be removed through the wiping process than the liquid having the low viscosity that is attached to the wiping surface.

In a case where a uniform force (wiping force) is applied from the wiper to the wiping surface, it is possible to improve removing performance of stains through the wiping process when the wiping force is applied for a long time in the wiping process. Accordingly, it is preferable that the liquid having the high viscosity that is attached to the wiping surface be wiped with the wiping force applied for a longer time, than the liquid having the low viscosity that is attached to the wiping surface.

Hence, when the wiper moves with respect to the wiping surface at a slower speed on the nozzle plate in which the nozzles that discharge the liquid having the high viscosity are formed than on the nozzle plate in which the nozzles that discharge the liquid having the low viscosity are formed, the wiping force is applied, for a longer time, to the liquid (stains) having the high viscosity that is attached to the nozzle plate, and thus it is possible to appropriately remove the liquid (stains) having the high viscosity.

Application Example 9

In the liquid discharge apparatus according to the application example, it is preferable that the wiping surface include a first region in which the nozzles are arranged and a second region in which no nozzles are arranged, and the wiper move with respect to the wiping surface at a slower speed in the second region than in the first region.

The stains attached to the first region, in which the nozzles are arranged, are removed by liquids discharged from the nozzles and the liquids discharged from the nozzles are attached to the first region. Further, since the liquids attached to the first region is changed to new liquids as the liquids are discharged from the nozzles, the liquids that is not subjected to a viscosity increase is attached to the first region.

The stains attached to the second region, in which no nozzles are arranged, are not removed by liquids discharged from the nozzles, then, liquids are discharged from the nozzles, and thereby stains are accumulated in the second region. Further, since the solvent component in the attached (accumulated) stains in the second region is evaporated, and the stains are increased in viscosity, the stains subjected to the viscosity increase are attached to the second region.

The stains, which are attached to the second region and are subjected to the viscosity increase, are more difficult to flow than the liquids which are attached to the first region and are not subjected to the viscosity increase, it is preferable that the wiping force be applied for a long time, the removing performance of the stains of the wiping process be improved, and wiping be performed.

Hence, when the wiper moves with respect to the wiping surface at a slower speed in the second region than in the first region, the wiping force is applied to the stains that are attached to the second region and are subjected to the viscosity increase, for a long time, and thus it is possible to appropriately remove the stains which are attached to the second region and are subjected to the viscosity increase.

Application Example 10

According to this application example, there is provided a method for wiping a liquid discharge head that includes a wiper, a wiping surface that is wiped with the wiper, a plurality of nozzles provided in the wiping surface, a drive element that causes a liquid to be discharged from the nozzles, a moving mechanism that causes the wiper and the wiping surface to relatively move, and a nozzle region which is interposed between edges of the wiping surfaces and in which the nozzles are arranged, the method includes: causing the wiper to relatively move in a direction from an edge of the wiping surface which is closer to the nozzle region toward an edge of the wiping surface which is apart from the nozzle region, and wiping the wiping surface.

Since the nozzles are arranged to be closer to one side of the wiping surface, a distance between an edge of the wiping surface and the nozzle is not uniform, and there are a portion having a long distance between the edge of the wiping surface and the nozzle and a portion having short distance between the edge of the wiping surface and the nozzle.

Since the stains are attached substantially evenly to the wiping surface, a large number of the stains are attached in the portion having the long distance between the edge of the wiping surface and the nozzle and a small number of the stains are attached in the portion having the short distance between the edge of the wiping surface and the nozzle. Accordingly, when the wiper is caused to move from the portion having a small number of attachment of the stains toward the portion having a large number of attachment of the stains, a small amount of the stains (foreign substances) moves along with the wiper, the foreign substances are unlikely to be rubbed into the inside of the nozzles, and a problem of the degradation of the ink discharge performance of the nozzles is unlikely to arise, compared to a case where the wiper is caused to move from the portion having a large number of attachment of the stains toward the portion having a small number of attachment of the stains.

When the wiper is caused to relatively move from the portion having a small number of attachment of the stains toward the portion having a large number of attachment of the stains and the wiper wipes the wiping surface, the wiper is caused to relatively move in a direction from the edge of the wiping surface on a side closer to the nozzle region toward the edge of the wiping surface on a side apart from the nozzle region, and the wiping is performed on the wiping surface. Therefore, according to the method for wiping a liquid discharge head of this application example, it is possible to reduce an occurrence of the problem arising in that foreign substances are rubbed into the inside of the nozzles and the ink discharge performance of the nozzles is degraded.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying figures. An embodiment according the invention represents an aspect of the invention, the invention is not limited thereto, and it is possible to arbitrarily modify the embodiment within a range of the technical idea of the invention. In addition, in the following figures, since layers or portions in the figures are shown in a degree of recognizable size, scales of the layers and the portions are different from real scales.

Embodiment 1

Overview of Printer

Figure 1:
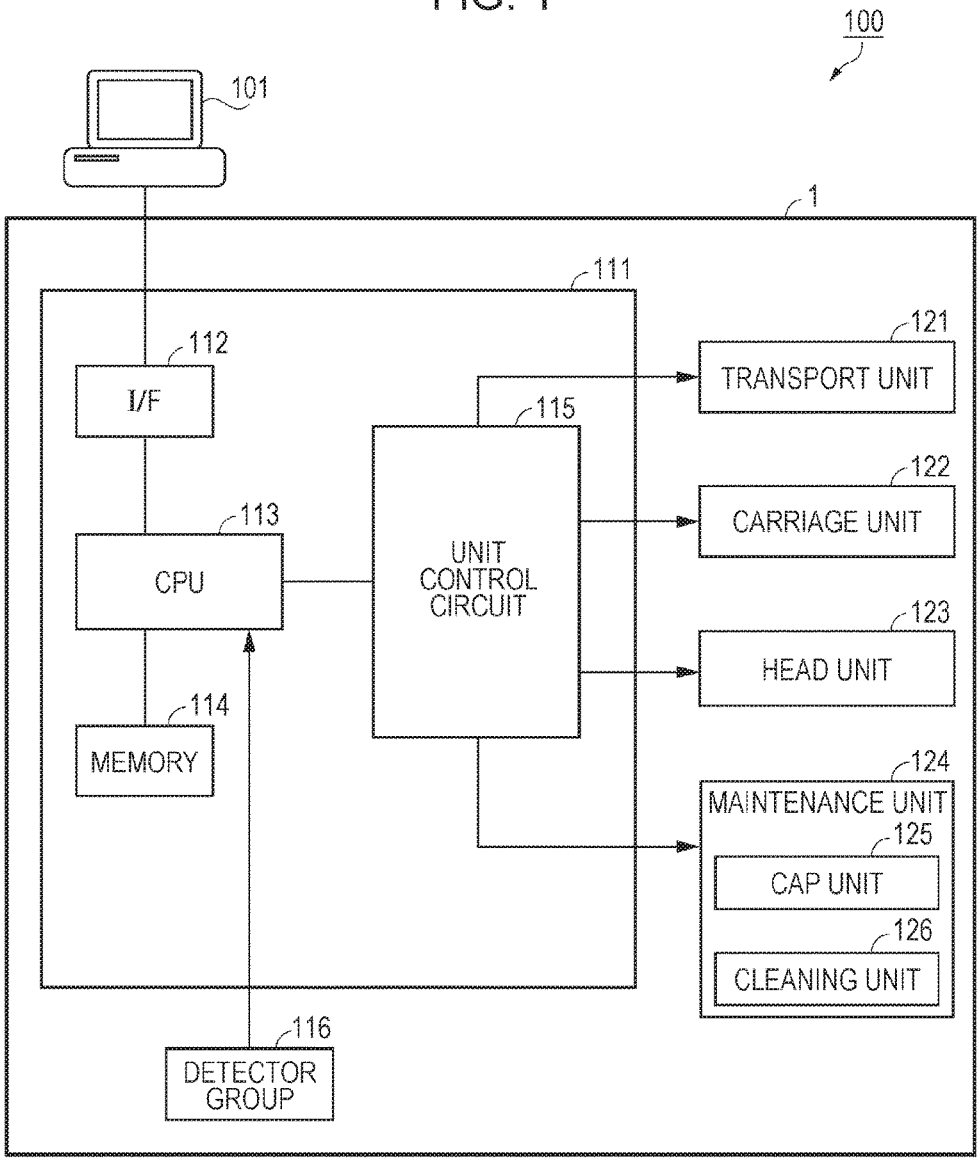
FIG. 1 is a diagram schematically illustrating a configuration of a printing system according to Embodiment 1.
Figure 2:
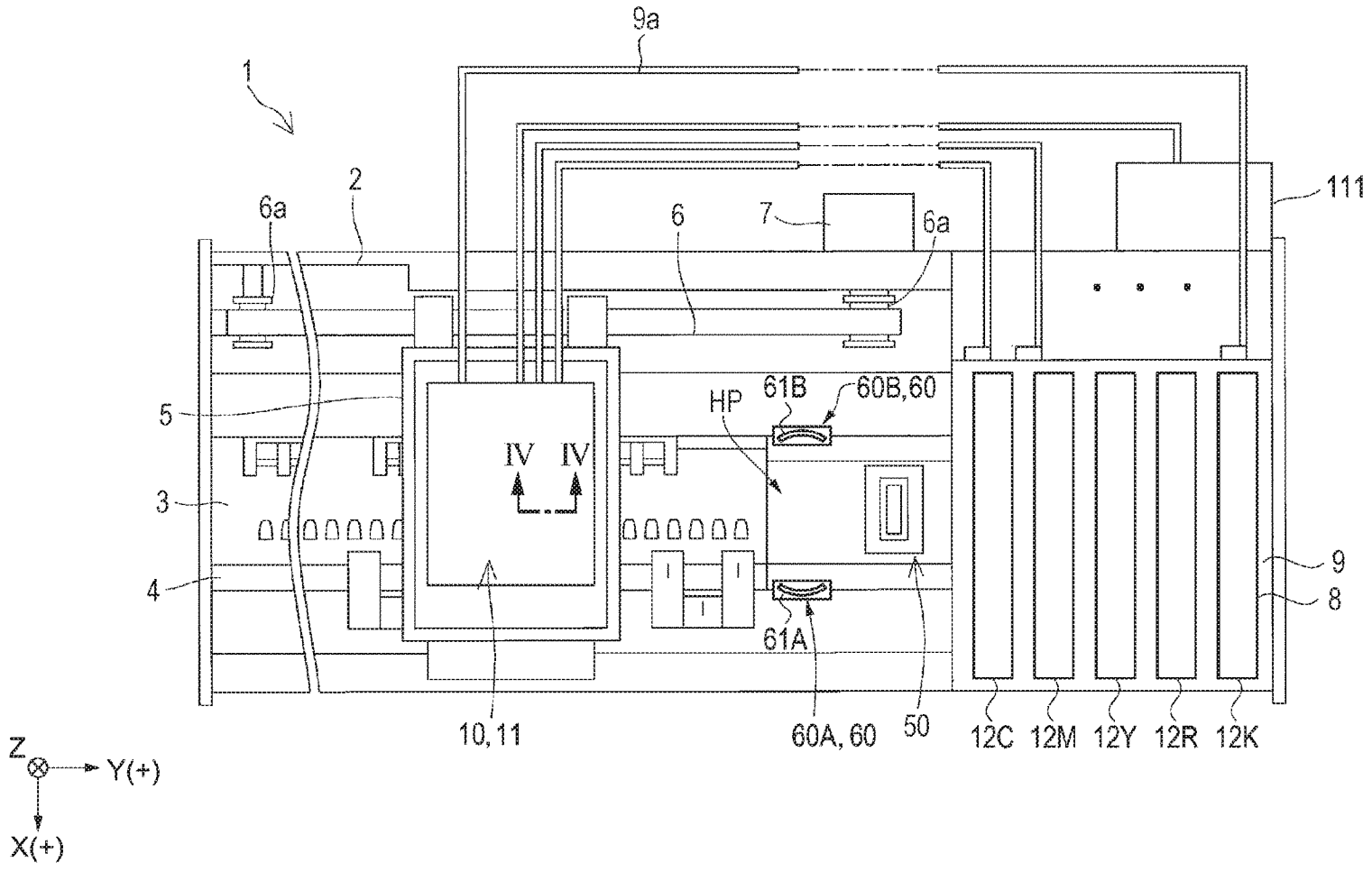
FIG. 2 is a plan view schematically illustrating a state of a printer according to Embodiment 1.

FIG. 1 is a diagram schematically illustrating a configuration of a printing system 100 according to Embodiment 1. FIG. 2 is a plan view schematically illustrating a state of an ink jet type recording apparatus (hereinafter, referred to as a printer) according to the embodiment.

First, an overview of a printer 1 according to the embodiment is described with reference to FIGS. 1 and 2.

As illustrated in FIG. 1, the printing system 100 is configured to include the printer 1 as an example of a "liquid discharge apparatus", and a computer 101.

The computer 101 is communicably connected to the printer 1 and outputs print data in response to an image to the printer 1. The printer 1, based on the print data output from the computer 101, ejects (discharges) an ink 12 (refer to FIG. 2) as an example of a "liquid" to a recording medium such as paper or a resin sheet, and records (prints) an image or the like on the recording medium.

The printer 1 includes a controller 111, a detector group 116, a transport unit 121, a carriage unit 122, a head unit 123, and a maintenance unit 124.

Note that the carriage unit 122 and a cleaning unit 126 are examples of a "moving mechanism".

The controller 111 is a control unit for controlling the printer 1. The controller 111 includes an interface unit (I/F) 112, a CPU 113, a memory 114, and a unit control circuit 115. The interface unit 112 transmits and receives data between the computer 101 and the printer 1. The CPU 113 is an arithmetic processing unit for controlling the entire printer 1. The memory 114 secures an operation region or a region in which a program of the CPU 113 is stored. The CPU 113 controls units 121, 122, 123, and 124 via the unit control circuit 115. The detector group 116 monitors a circumstance inside the printer 1 and the CPU 113 controls the units 121, 122, 123, and 124, based on the detection result of the detector group 116.

The transport unit 121 transports the recording medium to a predetermined position, and the carriage unit 122 causes an ink jet type recording head 10 (hereinafter, referred to as a recording head 10, refer to FIG. 2) to move to a predetermined position. The head unit 123 includes the recording head 10 that discharges the ink 12 to the recording medium.

Note that the recording head 10 is an example of a "liquid discharge head".

The maintenance unit 124 performs maintenance of the recording head 10 such that the ink 12 is appropriately discharged from the recording head 10, and includes a cap unit 125 and the cleaning unit 126.

As illustrated in FIG. 2, the printer 1 includes a main body frame 2 having a substantially rectangular box shape, and a medium support member 3 is disposed in a longitudinal direction of the main body frame 2 which is a main-scanning direction, in a lower portion in front inside the main body frame 2. The medium support member 3 has a substantially rectangular shape and is a support base that supports the recording medium. In addition, a bar-shaped guide shaft 4 is provided above the medium support member 3 in the main body frame 2 so as to extend to be parallel to the longitudinal direction of the main body frame 2.

A carriage 5 is supported by the guide shaft 4 in a state in which the carriage is capable of reciprocating along the guide shaft 4. The carriage 5 is connected to a carriage motor 7 provided in the main body frame 2, via an endless timing belt 6 that loops between a pair of pulleys 6*a* provided in the main body frame 2. In this manner, the carriage 5 reciprocates along the guide shaft 4 by the driving of the carriage motor 7. The guide shaft 4, the carriage 5, the carriage motor 7, and the pulley 6*a* configure a part of the carriage unit 122.

The carriage 5 holds the recording head 10. The recording head 10 is able to move in a short direction (sub-scanning direction) of the main body frame 2 by the carriage unit 122. Further, the transport unit 121 is capable of transporting the recording medium in a main-scanning direction (short direction of the main body frame 2).

In the following description, the sub-scanning direction (short direction of the main body frame 2) is an X direction, the main-scanning direction (longitudinal direction of the main body frame 2) orthogonal to the sub-scanning direction is a Y direction, and a direction (thickness direction of the main body frame 2) orthogonal to the main-scanning direction and the sub-scanning direction is a Z direction. Further, a front end side of an arrow representing a direction in the figures is a "(+) direction" and a base end side thereof is a "(−) direction".

A tank holder 9 is provided on one end side of the main body frame 2 in the Y direction, and five ink tanks 8 as liquid supply sources are detachably mounted to the tank holder 9. Different types (colors) of inks are contained in the ink tanks 8, respectively. In the embodiment, a cyan (C) ink 12C, a magenta (M) ink 12M, a yellow (Y) ink 12Y, a red (R) ink 12R, and a black (K) ink 12K are contained in the ink tanks 8, respectively.

Note that the number of ink tanks 8 is not limited thereto, one ink tank may be provided, or two or a plurality of ink tanks may be provided.

In the following description, the inks 12C, 12M, 12Y, 12R, and 12K are collectively referred to as the ink 12, in some cases.

In a state in which the ink tanks 8 are mounted in the tank holder 9, the ink 12 contained in the ink tank 8 is pressurized by a pressure feeding unit (not illustrated), and is supplied to the recording head 10 via an ink supply tube 9*a* and a valve unit (not illustrated). Note that, for example, examples of the pressure feeding unit include a pressing unit that presses the ink tank 8 from the outside, a pressure pump, and the like.

The valve unit is a flow path member having a pressure-regulating valve inside and regulates a flow pressure of the ink 12 that is supplied to the recording head 10 such that the ink 12 is stably discharged from nozzles 31 (refer to FIG. 4) of the recording head 10.

A suction unit 50 that suctions the ink 12 from the nozzles 31 of the recording head 10 is provided at a home position region HP of the carriage 5 at a position which is closer to one end portion in the main body frame 2 in the Y direction.

The suction unit 50 form a part of the cap unit 125, and performs a flushing process in which the ink 12 subjected to a viscosity increase or the ink 12 into which bubbles are mixed is forced to be emitted from the recording head 10. A wiping portion 60 to be described below configures a part of the cleaning unit 126, performs a wiping process of removing stains attached to a wiping surface 11 of the recording head 10, and performs a wiping process.

The wiping portions 60 are provided at two positions in the printer 1. Specifically, a first wiping portion 60A is provided on the X(+) direction side of the home position region HP, and a second wiping portion 60B is provided on the X(−) direction side of the home position region HP. The first wiping portion 60A has a first wiper 61A and the second wiping portion 60B has a second wiper 61B. The first wiper 61A and the second wiper 61B are formed of an elastic material such as rubber or an elastomer.

In the following description, the first wiper 61A and the second wiper 61B are collectively referred to as the wiper 61, in some cases.

The carriage unit 122 is cable of causing the wiping surface 11 of recording head 10 to move to a predetermined position. In other words, the carriage unit 122 adjusts a position of the wiping surface 11 of the recording head 10.

The cleaning unit 126 is cable of causing the wiper 61 to move to a predetermined position. Further, the cleaning unit 126 regulates a force (wiping force) of the wiper 61 that is applied to the wiping surface 11 such that the uniform force is applied. In other words, the cleaning unit 126 regulates the position of the wiper 61 and the wiping force of the wiper 61.

In the wiping process, while the wiper 61 applies the uniform wiping force to the wiping surface 11 of the recording head 10, the wiper 61 relatively moves with respect to the wiping surface 11 of the recording head 10, thereby removing the stains attached to the wiping surface 11 of the recording head 10.

In the embodiment, the carriage unit 122 and the cleaning unit 126 cause both of the wiper 61 and the recording head 10 to move and cause the wiper 61 to relatively move with respect to the wiping surface 11 of the recording head 10.

Note that only the wiper 61 may be caused to move and the wiper 61 may be caused to relatively move with respect to the wiping surface 11 of the recording head 10. Otherwise, only the recording head 10 may be caused to move and the wiper 61 may be caused to relatively move with respect to the wiping surface 11 of the recording head 10.

In the following description, the movement of the wiper 61 with respect to the wiping surface 11 is the same as the relative movement of the wiper 61 with respect to the wiping surface 11, and the movement of the wiper 61 includes the relative movement of the wiper 61.

In the printer 1, both of an ink droplet discharge operation in which the recording head 10 is caused to move in the main-scanning direction (Y direction) while the ink droplets are caused to be discharged from the nozzles 31, and a transport operation in which the recording medium is fed in the sub-scanning direction (X direction) are alternately repeated, rows (raster lines) of dots aligned in the main-scanning direction are arranged in parallel in the sub-scanning direction, and thereby a desired image is printed on the recording medium.

Overview of Recording Head

Figure 3:
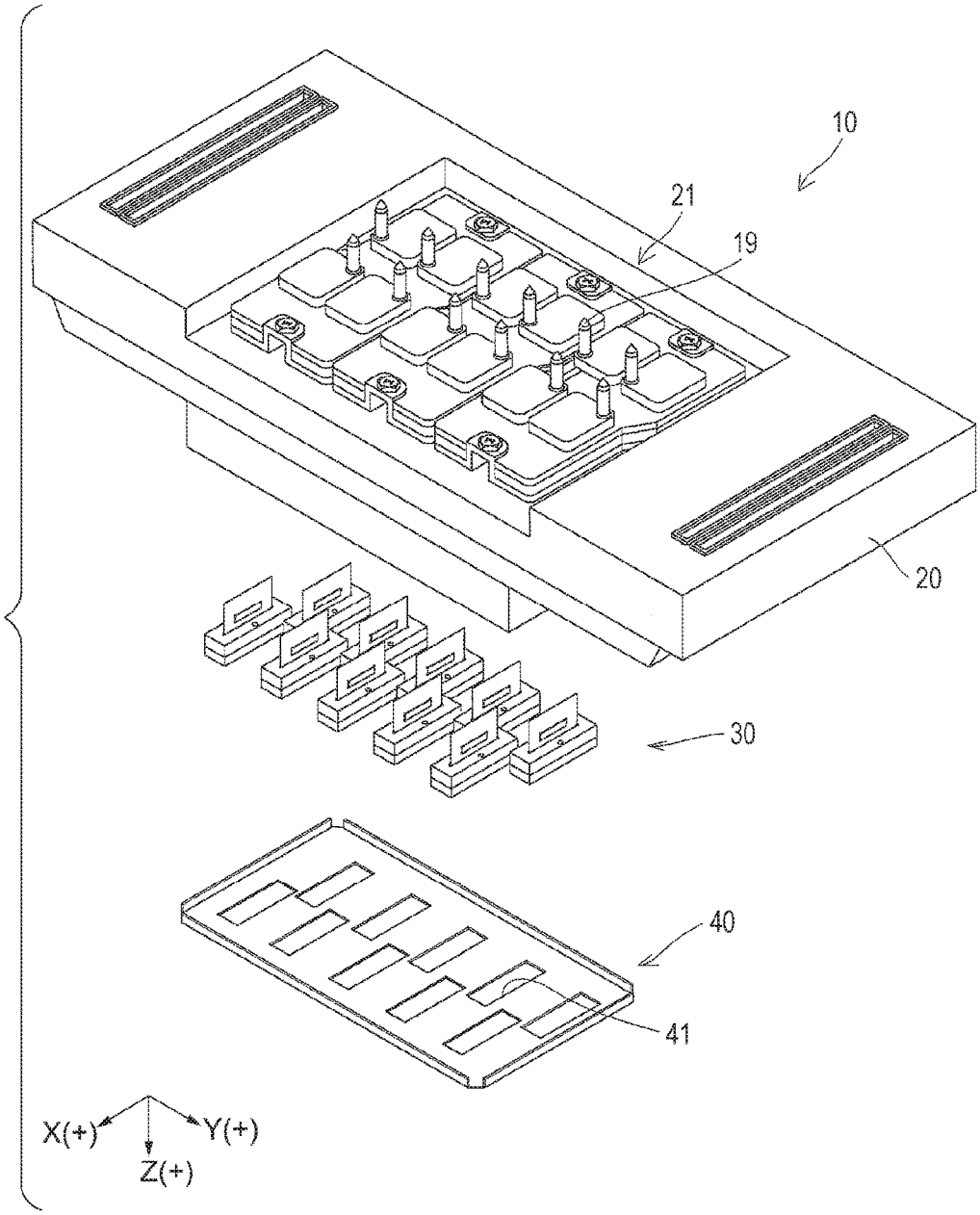
FIG. 3 is an exploded perspective view of a recording head.
Figure 4:
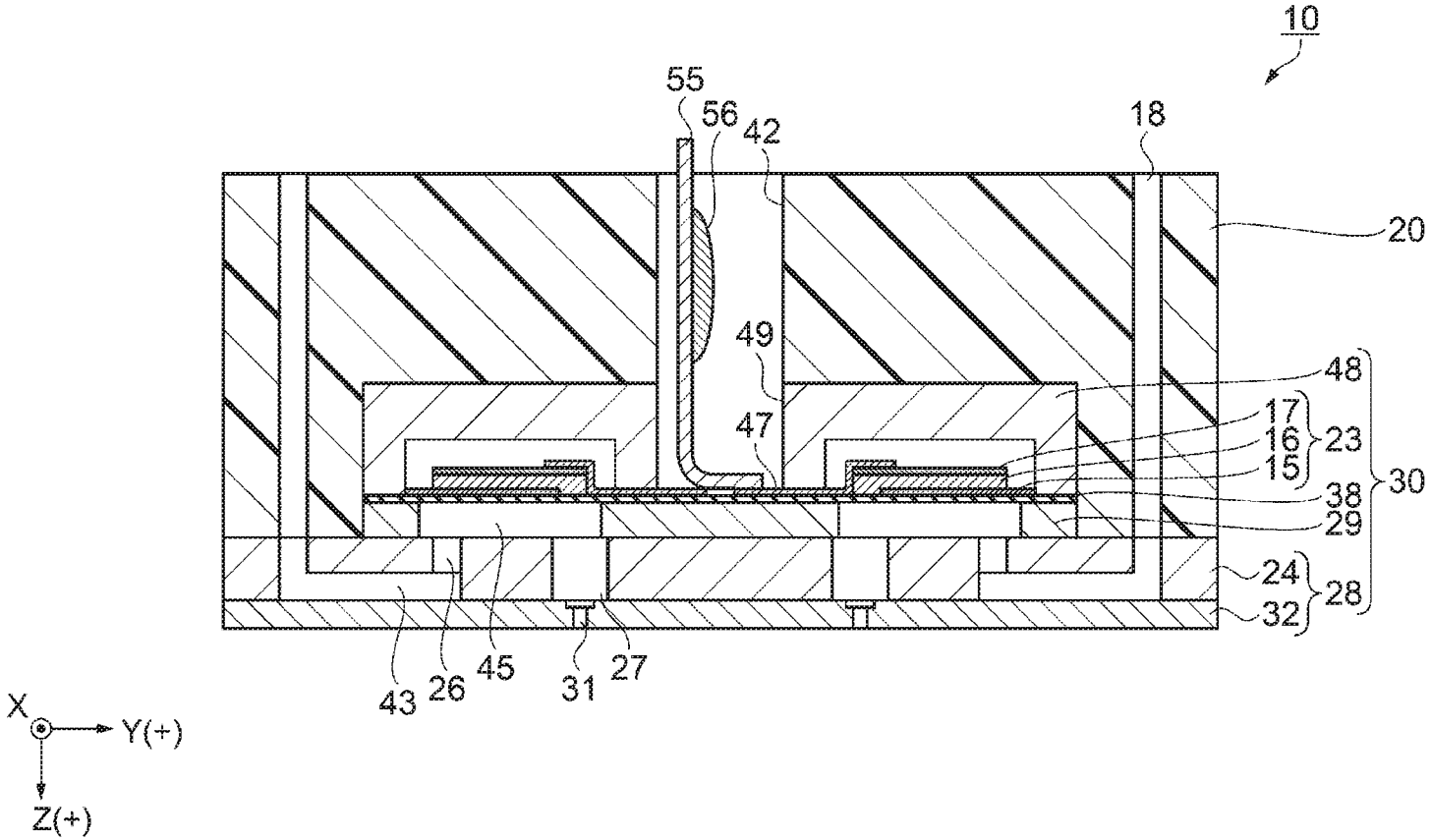
FIG. 4 is a sectional view of main parts of a head main body taken along line IV-IV in FIG. 2.
Figure 5:
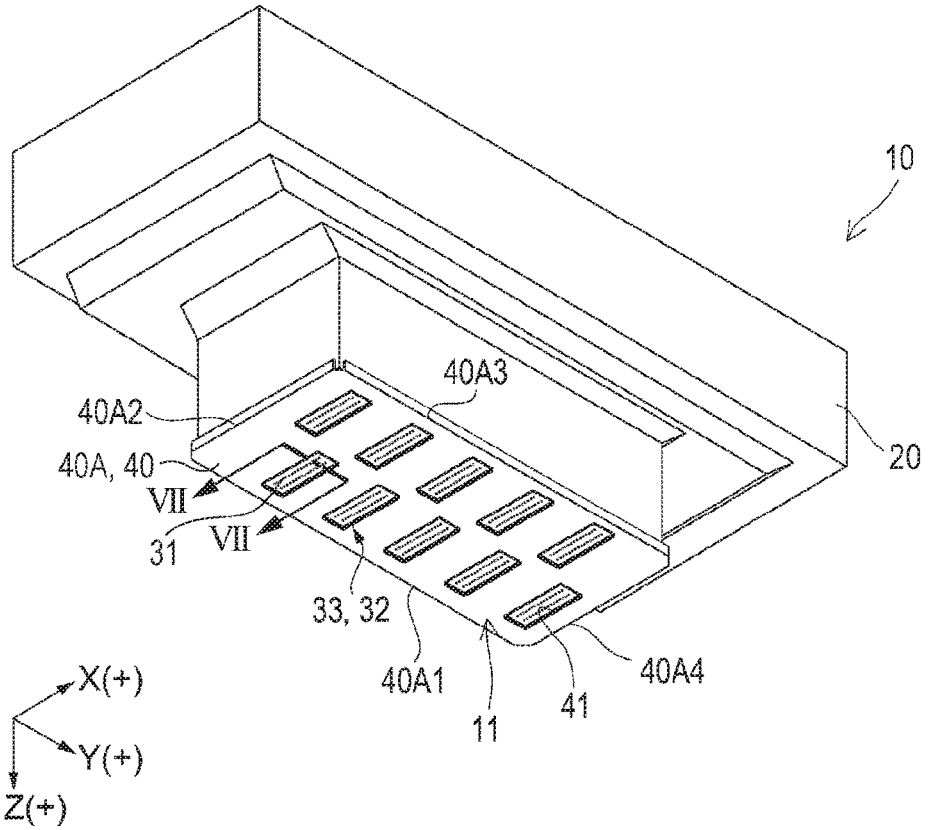
FIG. 5 is a perspective view of the recording head.
Figure 6:
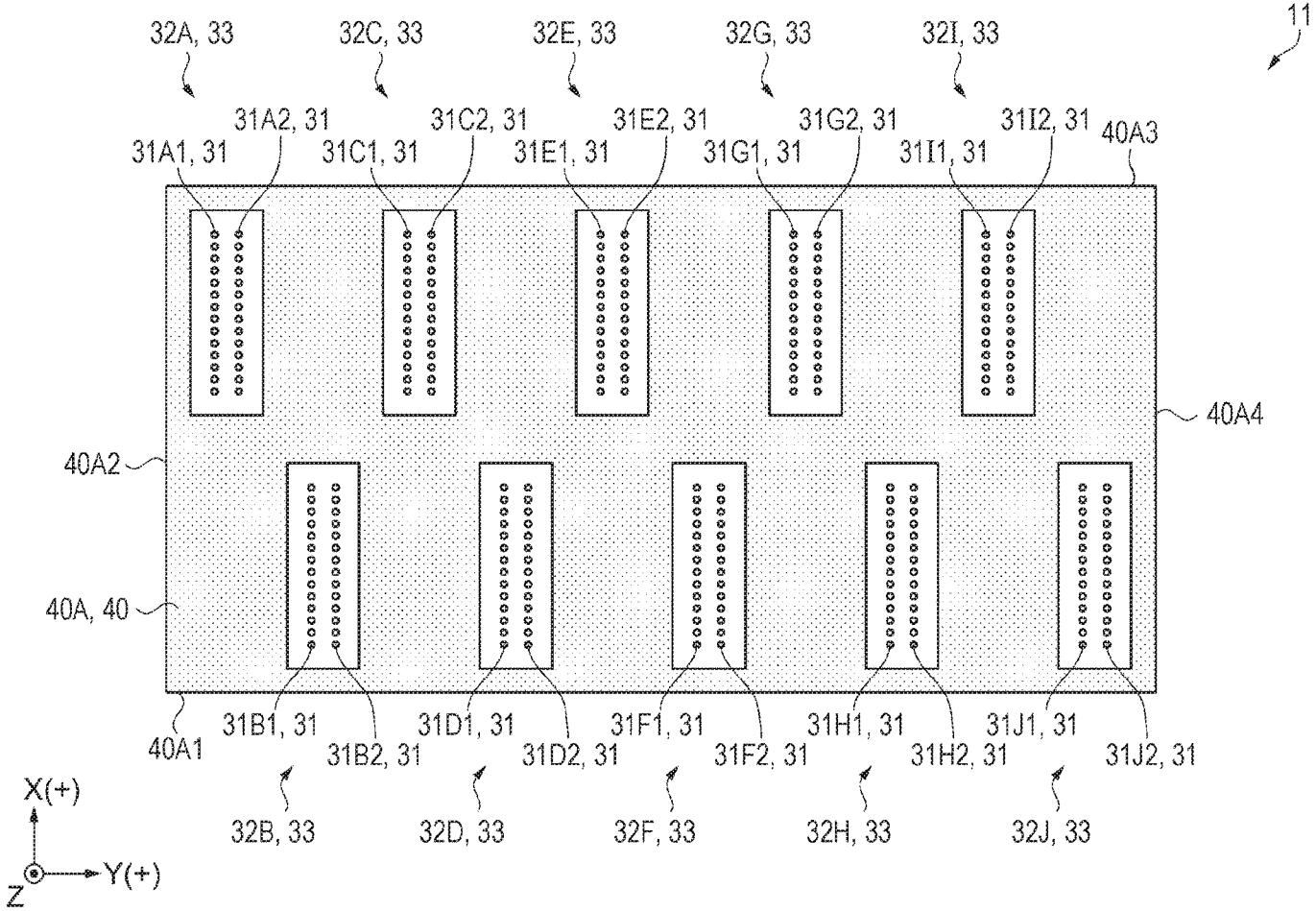
FIG. 6 is a plan view schematically illustrating a state of a wiping surface.
Figure 7:
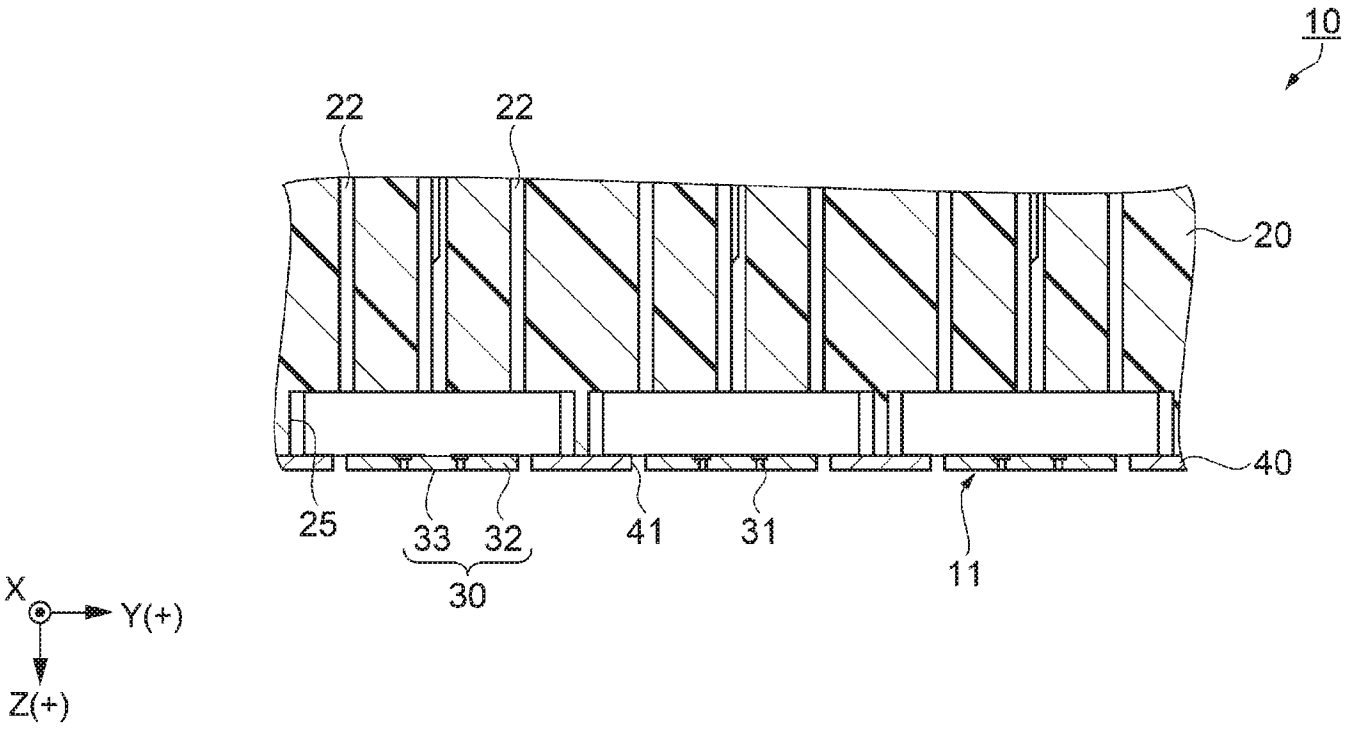
FIG. 7 is a schematic sectional view taken along line VII-VII in FIG. 5.

FIG. 3 is an exploded perspective view of the recording head. FIG. 4 is a sectional view of main parts of a head main body taken along line IV-IV in FIG. 2. FIG. 5 is a perspective view of the recording head when viewed from the Z(+) direction side. FIG. 6 is a plan view schematically illustrating a state of the wiping surface when viewed from the Z(+) direction side. FIG. 7 is a schematic sectional view taken along line VII-VII in FIG. 5.

Hereinafter, an overview of the recording head 10 will be described with reference to FIGS. 3 to 7.

As illustrated in FIG. 3, the recording head 10 includes a head case 20, a plurality of head main bodies 30, and a fixing plate 40. The fixing plate 40 is a member that protects a surface of the head case 20 on the Z(+) direction side from being stained with ink droplets or the like. The head case 20 is a member that holds (fixes) the head main bodies 30 or the fixing plate 40.

The fixing plate 40 is provided with openings 41 corresponding to the head main bodies 30, respectively, through which nozzle plates 32 (refer to FIG. 4) of the head main bodies 30 are exposed. The fixing plate 40 is provided with ten openings 41. The opening 41 is opened to be larger than the nozzle plate 32. Note that the opening 41 may be opened to be smaller than the nozzle plate 32 and may adhere to a front surface of the nozzle plate 32 of the fixing plate 40 directly or via another member.

The fixing plate 40 adheres to a portion other than the nozzle plate 32 of the head main body 30 and is fixed to a surface of the head case 20 on the Z(+) direction side, that is, to the periphery of an opening of a head-main-body holder 25 (refer to FIG. 7) via an adhesive or the like.

The head case 20 is box-shaped member made of a synthetic resin and has a mounting portion 21 that is connected to an ink supply port of the valve unit. The mounting portion 21 is provided with an ink supply needle 19 that is inserted into the ink supply port of the valve unit.

As illustrated in FIG. 4, the head main body 30 has a configuration in which a flow path unit 28, a pressure-generating-chamber forming substrate 29, a vibration plate 38, a piezoelectric element 23, and a protection substrate 48 are stacked in this order, and is attached to the head case 20.

Note that the piezoelectric element 23 is an example of a "drive element".

A reservoir 18 is formed inside the head case 20 and supplies the ink 12 to pressure generating chambers 45. The reservoir 18 is a space which is common to a plurality of pressure generating chambers 45 which are provided in parallel with each other and in which the ink 12 is stored, and two reservoirs are formed to correspond to two rows of the pressure generating chambers 45 provided in parallel with each other. Further, the head case 20 is provided with an ink communicating path 22 (refer to FIG. 7) through which the ink 12 is guided to the reservoir 18 from the valve unit. In addition, a filter (not illustrated) is disposed inside the ink communicating path 22 and removes bubbles or foreign substances in the ink 12.

The flow path unit 28 has a communication substrate 24 and the nozzle plate 32. The communication substrate 24 is a plate member made of silicon. In the communication substrate 24, a common liquid chamber 43 which communicates with the reservoir 18 and is common to the pressure generating chambers 45, and in which the ink 12 is stored, and an individual communication path 26 through which the ink 12 is supplied to the pressure generating chamber 45, individually, via the common liquid chamber 43 from the reservoir 18.

The common liquid chamber 43 is an elongated cavity in a nozzle-array direction, and two rows of common liquid chambers are formed to correspond to the two rows of the pressure generating chambers 45 provided to be parallel to each other. A plurality of individual communication paths 26 are formed to correspond to the pressure generating chambers 45 in an arrangement direction of the pressure generating chambers 45.

Nozzle communicating paths 27 are formed at positions corresponding to the nozzles 31 of the communication substrate 24 and penetrate through the communication substrate 24 in a thickness direction. The pressure generating chamber 45 and the nozzle 31 communicate with each other through the nozzle communicating path 27.

The nozzle plate 32 is a silicon substrate that adheres to a surface of the communication substrate 24 on the Z(+) direction side. The nozzle plate 32 seals an opening of a space as the common liquid chamber 43 on the Z(+) direction side. The nozzle plate 32 is provided with a plurality of nozzles 31 in a straight line shape (row shape). In the embodiment, two rows of nozzles 31 are formed to correspond to the two rows of the pressure generating chambers 45 (refer to FIG. 6).

Note that the nozzle plate can adhere to a region of the communication substrate which projects to the inner side from the common liquid chamber and it is possible to seal the opening of a space as the common liquid chamber on the lower surface side with a member such as a flexible compliance sheet. In this manner, it is possible to decrease the nozzle plate in size to the largest extent.

The pressure-generating-chamber forming substrate 29 is a silicon substrate that adheres to a surface of the communication substrate 24 on the Z(−) direction side. The pressure-generating-chamber forming substrate 29 has a space (cavity) in which the pressure generating chamber 45 is formed. The cavity of the pressure-generating-chamber forming substrate 29 and a region surrounded by the vibration plate 38 and the communication substrate 24 form the pressure generating chamber 45. The pressure generating chamber 45 is an elongated cavity in a direction orthogonal to the nozzle array direction, the individual communication path 26 communicates with one end portion of the cavity in the longitudinal direction, and the nozzle communicating path 27 communicates with the other end thereof.

The vibration plate 38 is an elastic thin membrane-like member and is formed on a surface of the pressure-generating-chamber forming substrate 29 on the Z(−) direction side. The vibration plate 38 is configured of an elastic membrane made of silicon oxide which is formed on the surface of the pressure-generating-chamber forming substrate 29 on the Z(−) direction side, and an insulation membrane made of zirconium oxide that is formed on the elastic membrane.

The piezoelectric element 23 is a thin membrane-like piezoelectric device that functions as an actuator which produces a pressure change in the ink 12 in the pressure generating chambers 45, and is formed on the surface of the vibration plate 38 on the Z(−) direction side. The piezoelectric element 23 is a piezoelectric device having a so-called flexure mode and is shifted in a receding direction or in an approaching direction from or to the nozzle 31.

Note that the piezoelectric element 23 may be a piezoelectric device having a longitudinal vibration mode in which the device extends and contracts in an axial direction.

The piezoelectric element 23, a first electrode 15, a piezoelectric layer 16, and a second electrode 17 are stacked in this order. Here, the piezoelectric element 23 means a portion including the first electrode 15, the piezoelectric layer 16, and the second electrode 17. The piezoelectric element 23 has a configuration in which one electrode is patterned as a common electrode, the other electrode and the piezoelectric layer 16 are patterned for each pressure generating chamber 45. In the element, the first electrode 15 is patterned as the common electrode of the piezoelectric element 23 and the second electrode 17 is patterned as an individual electrode of the piezoelectric element 23; however, the patterning may be performed the other way around depending on a drive circuit or wiring.

The protection substrate 48 for protecting the piezoelectric element 23 adheres to the pressure-generating-chamber forming substrate 29 (vibration plate 38). The piezoelectric element 23 is sealed with the pressure-generating-chamber forming substrate 29 and the protection substrate 48, an influence of external water (moisture) is reduced, and thus, degradation of the piezoelectric element 23 due to water is reduced.

A lead electrode 47 is connected to the second electrodes 17 as the individual electrodes of the piezoelectric element 23 and the lead electrode is pulled out from the vicinity of an end portion on a side opposite to the individual communication path 26 and extends onto the vibration plate 38.

Further, the head case 20 is provided with a connection port 42 which communicates with a through-hole 49 of the protection substrate 48 and into which a wiring substrate 55 is inserted. In addition, the wiring substrate 55 is provided with a drive circuit 56 and the wiring substrate 55 inserted into the connection port 42 is connected to the lead electrode 47.

In the recording head 10, the ink 12 from the ink tank 8 is guided to the pressure generating chamber 45 via the ink communicating path 22, the reservoir 18, the common liquid chamber 43, and the individual communication path 26. Further, a drive signal from the drive circuit 56 drives the piezoelectric element 23, and the piezoelectric element 23 and the vibration plate 38 are shifted in the receding direction or in the approaching direction from or to the nozzle 31. The pressure change is produced in the pressure generating chamber 45 due to the shift, and the ink 12 is discharged as the ink droplets from the nozzles 31 via the nozzle communicating path 27.

As described above, the printer 1 according to the element includes the wiper 61, the wiping surface 11 that is wiped with the wiper 61, the plurality of nozzles 31 provided in the wiping surface 11, the piezoelectric element 23 that causes the ink 12 to be discharged from the nozzles 31, and the carriage unit 122 and the cleaning unit 126 that perform relative movement of the wiper 61 and the wiping surface 11.

As illustrated in FIG. 7, the head case 20 is provided with the ink communicating path 22 having one end that is connected to the ink supply port (not illustrated) of the valve unit and the other end that is connected to the reservoir 18.

In addition, a head-main-body holder 25 (recessed portion), inside which the head main body 30 can be accommodated, is provided on a surface of the head case 20 on the Z(+) side facing the recording medium (medium supporting member 3). The head-main-body holder 25 is provided individually for each head main body 30 and the head main body 30 is accommodated in the head-main-body holder 25 of the head case 20.

Note that the head-main-body holder 25 may be provided for the plurality of head main bodies 30.

As illustrated in FIG. 5, the fixing plate 40 and the plurality of nozzle plates 32 are disposed on the surface of the recording head 10 on the Z(+) side facing the recording medium (medium support member 3). The wiping surface 11 that is wiped with the wiper 61 is configured of the fixing plate 40 and the plurality of nozzle plates 32. Specifically, the wiping surface 11 is configured of a surface (hereinafter, referred to as a front surface 40A) of the fixing plate 40 on the Z(+) direction side and surfaces (hereinafter, referred to as nozzle formed surfaces 33) of the nozzle plates 32 on the Z(+) direction side in which the plurality of nozzles 31 are formed.

In other words, the wiping surface 11 is configured of a region (region in which the nozzles 31 are arranged) in which the nozzle formed surfaces 33 of the nozzle plates 32 are arranged and a region (region in which no nozzles 31 are arranged) in which the front surface 40A of the fixing plate 40 is disposed.

Note that the region, in which the nozzle formed surfaces 33 are arranged, is an example of a "first region", and the region, in which the front surface 40A of the fixing plate 40 is disposed, is an example of a "second region".

It is possible to adjust a position of the nozzle formed surface 33 in the Z direction with a shape of the head-main-body holder 25. In the embodiment, the front surface 40A of the fixing plate 40 and the nozzle formed surface 33 are disposed substantially at the same position in the Z direction, and the head-main-body holder 25 is formed such that the wiping surface 11 is flat.

Note that the front surface 40A of the fixing plate 40 and the nozzle formed surface 33 may be disposed at different positions in the Z direction.

The front surface 40A of the fixing plate 40 has a side 40A1, a side 40A2, a side 40A3, and a side 40A4. In other words, a surface surrounded by the side 40A1, the side 40A2, the side 40A3, and the side 40A4 is the front surface 40A. The side 40A1 is an end of the front surface 40A on the X(−) direction side, the side 40A2 is an end of the front surface 40A on the Y(−) direction side, the side 40A3 is an end of the front surface 40A on the X(+) direction side, and the side 40A4 is an end of the front surface 40A on the Y(+) direction side.

In FIG. 6, a shaded region represents the front surface 40A of the fixing plate 40 and unshaded region represents the nozzle formed surface 33 of the nozzle plate 32.

Note that the shaded region is the region, in which the front surface 40A of the fixing plate 40 is disposed, and corresponds to the "second region" in this application. The unshaded region is the region, in which the nozzles 31 are arranged, and corresponds to the "first region" in this application.

As illustrated in FIG. 6, on the wiping surface 11 of the recording head 10, the front surface 40A of the fixing plate 40 and the nozzle formed surfaces 33 of ten nozzle plates 32 (nozzle plates 32A, 32B, 32C, 32D, 32E, 32F, 32G, 32H, 32I, 32J) are arranged.

The ten nozzle plates 32 (nozzle plates 32A, 32B, 32C, 32D, 32E, 32F, 32G, 32H, 32I, 32J) are arranged to be closer to one side of the wiping surface 11. Therefore, a distance between the side 40A1 and the ten nozzle plates 32 is different from a distance between the side 40A3 and the nozzle plates, and a distance between the side 40A2 and the nozzle plates is different from a distance between the side 40A4 and the nozzle plates.

The five nozzle plates 32A, 32C, 32E, 32G, 32I are arranged in this order in the Y direction, and the other five nozzle plates 32B, 32D, 32F, 32H, 32J are arranged in this order in the Y direction.

The five nozzle plates 32A, 32C, 32E, 32G, 32I and the other five nozzle plates 32B, 32D, 32F, 32H, 32J are arranged not to overlap each other when viewed in the X direction. In other words, the ten nozzle plates 32 (nozzle plates 32A, 32B, 32C, 32D, 32E, 32F, 32G, 32H, 32I, 32J) are arranged in a zigzag pattern.

The nozzles 31 formed in the five nozzle plates 32A, 32C, 32E, 32G, 32I are arranged to overlap each other when viewed in the Y direction. The nozzles 31 formed in the other five nozzle plates 32B, 32D, 32F, 32H, 32J are also arranged to overlap each other.

Note that some nozzles 31 formed in the five nozzle plates 32A, 32C, 32E, 32G, 32I and some nozzles 31 formed in the other five nozzle plates 32B, 32D, 32F, 32H, 32J may be arranged to overlap each other when viewed in the Y direction.

Two nozzle arrays in which the plurality of nozzles 31 are arranged in the X direction are formed in the nozzle plate 32. In other words, two nozzle arrays 31A1 and 31A2 are formed in the nozzle plate 32A. Two nozzle arrays 31B1 and 31B2 are formed in the nozzle plate 32B. Two nozzle arrays 31C1 and 31C2 are formed in the nozzle plate 32C. Two nozzle arrays 31D1 and 31D2 are formed in the nozzle plate 32D. Two nozzle arrays 31E1 and 31E2 are formed in the nozzle plate 32E. Two nozzle arrays 31F1 and 31F2 are formed in the nozzle plate 32F. Two nozzle arrays 31G1 and 31G2 are formed in the nozzle plate 32G. Two nozzle arrays 31H1 and 31H2 are formed in the nozzle plate 32H. Two nozzle arrays 31I1 and 31I2 are formed in the nozzle plate 32I. Two nozzle arrays 31J1 and 31J2 are formed in the nozzle plate 32J.

In the following description, the arrays are collectively referred to as the nozzle array 310, in some cases.

In the embodiment, the cyan (C) ink 12C is discharged from the nozzle arrays 31A1, 31A2, 31B1, and 31B2, the magenta (M) ink 12M is discharged from the nozzle arrays 31C1, 31C2, 31D1, and 31D2, the yellow (Y) ink 12Y is discharged from the nozzle arrays 31E1, 31E2, 31F1, and 31F2, the red (R) ink 12R is discharged from the nozzle arrays 31G1, 31G2, 31H1, and 31H2, and the black (K) ink 12K is discharged from the nozzle arrays 31I1, 31I2, 31J1, and 31J2.

As described above, a total of 20 nozzle arrays 310 are arranged in the recording head 10, and the inks 12 of five colors are discharged. Note that the colors of the inks 12 that are discharged from the recording head 10 may be smaller than five colors or may be larger than five colors. For example, a configuration in which different color inks 12 are discharged from the total 20 nozzle arrays 310, respectively, may be employed. Therefore, in the embodiment, the recording head 10 can discharge the maximum 20 color links 12.

Next, an overview of the ink 12 will be described.

The ink 12 contains a color material, water, and a humectant. In other words, the ink 12 is a water-based ink containing an aqueous solvent.

It is possible to use a pigment or dye as the color material. The color of the ink 12 is determined depending on the color material.

The water is a medium that disperses the color material and, for example, it is possible to use pure water or ultrapure water such as ion-exchanged water, ultrafiltration water, reverse osmosis water, or distilled water. Ions or the like may exist in the water to the extent that the ions or the like do not interfere with the dispersion of the color material. Sterilized water subjected to the ultraviolet irradiation or by adding hydrogen peroxide reduces an occurrence of mold or bacteria and thus, it is possible to increase stability of the ink 12.

The humectant plays a role of reducing evaporation (drying of the ink 12) of water. As the humectant, it is possible to use polyhydric alcohols, amino-acid derivatives, pyrrolidone derivatives, saccharides, or the like.

Examples of the polyhydric alcohols include ethylene glycol, diethylene glycol, triethylene glycol, polyethyleneglycol, polypropylene glycol, propylene glycol, butylene glycol, alkane diol having four to eight carbon atoms such as 1,2-butanediol, 1,2-pentanediol, 1,2-hexanediol, 1,2-heptanediol, 1,2-octanediol, 1,2,6-hexanetriol, thioglycol, hexylene glycol, glycerine, trimethylolethane, trimethylolpropane, glycol ethers, and the like.

Examples of the amino-acid derivatives include betaines which are N-trialkyl substituent of amino acid such as glycine betaine, atorinine, carnitine, γ-butyrobetaine, trigonelline, β-alanine betaine, homarine, homoserine betaine, anthopleurin, valine betaine, lysine betaine, ornithine betaine, alanine betaine, taurobetaine, stachydrine, glutamic acid betaine, or phenylalanine betaine.

Examples of the pyrrolidone derivatives include N-methyl-2-pyrrolidone, N-ethyl-2-pyrrolidone, N-vinyl-2-pyrrolidone, 2-pyrrolidone, N-butyl-2-pyrrolidone, 5-methyl-2-pyrrolidone, polyvinylpyrrolidone, and the like.

Examples of the saccharides include monosaccharides, oligosaccharides, and polysaccharides. Specifically, examples of the saccharides include glucose, mannose, galactose, fucose, ribose, fructose, xylose, arabinose, maltose, cellobiose, lactose, sucrose, trehalose, raffinose, panose, YI maltose, stachyose, gentiobiose, gentianose, and the like.

In the embodiment, glycerin is used as the humectant. The glycerin has high hygroscopicity. The glycerin is added to the ink 12, thereby, evaporation of water is reduced and thus, it is possible to increase the stability of the ink 12.

Further, since the glycerin has a viscosity higher than the water, the ink 12 has a low viscosity when a glycerin content rate (an amount of glycerin added into the ink 12) of the ink 12 is decreased. The ink 12 has a high viscosity when the glycerin content rate of the ink 12 is increased.

Hence, it is possible to adjust the viscosity of the ink 12 with the glycerin content rate of the ink 12.

In the embodiment, the glycerin content rates of the inks 12 are decreased in the order from the ink 12C, the ink 12M, the ink 12Y, the ink 12R, to the ink 12K. The viscosity of the ink 12 is decreased in the order from the ink 12C, the ink 12M, the ink 12Y, the ink 12R, to the ink 12K.

Therefore, the glycerin content rates of the inks 12 that are discharged from the nozzle plates 32 and the viscosity of the inks 12 that are discharged from the nozzle plates 32 are decreased in the order from the nozzle plate 32A, the nozzle plate 32C, the nozzle plate 32E, the nozzle plate 32G, to the nozzle plate 32I of the five nozzle plates 32A, 32C, 32E, 32G, and 32I arranged in the Y direction.

Further, the glycerin content rates of the inks 12 that are discharged from the nozzle plates 32 and the viscosity of the inks 12 that are discharged from the nozzle plates 32 are decreased in the order from the nozzle plate 32B, the nozzle plate 32D, and the nozzle plate 32F, the nozzle plate 32H, to the nozzle plate 32J of the five nozzle plates 32B, 32D, 32F, 32H, and 32J arranged in the Y direction.

Wiping Process

Figure 8:
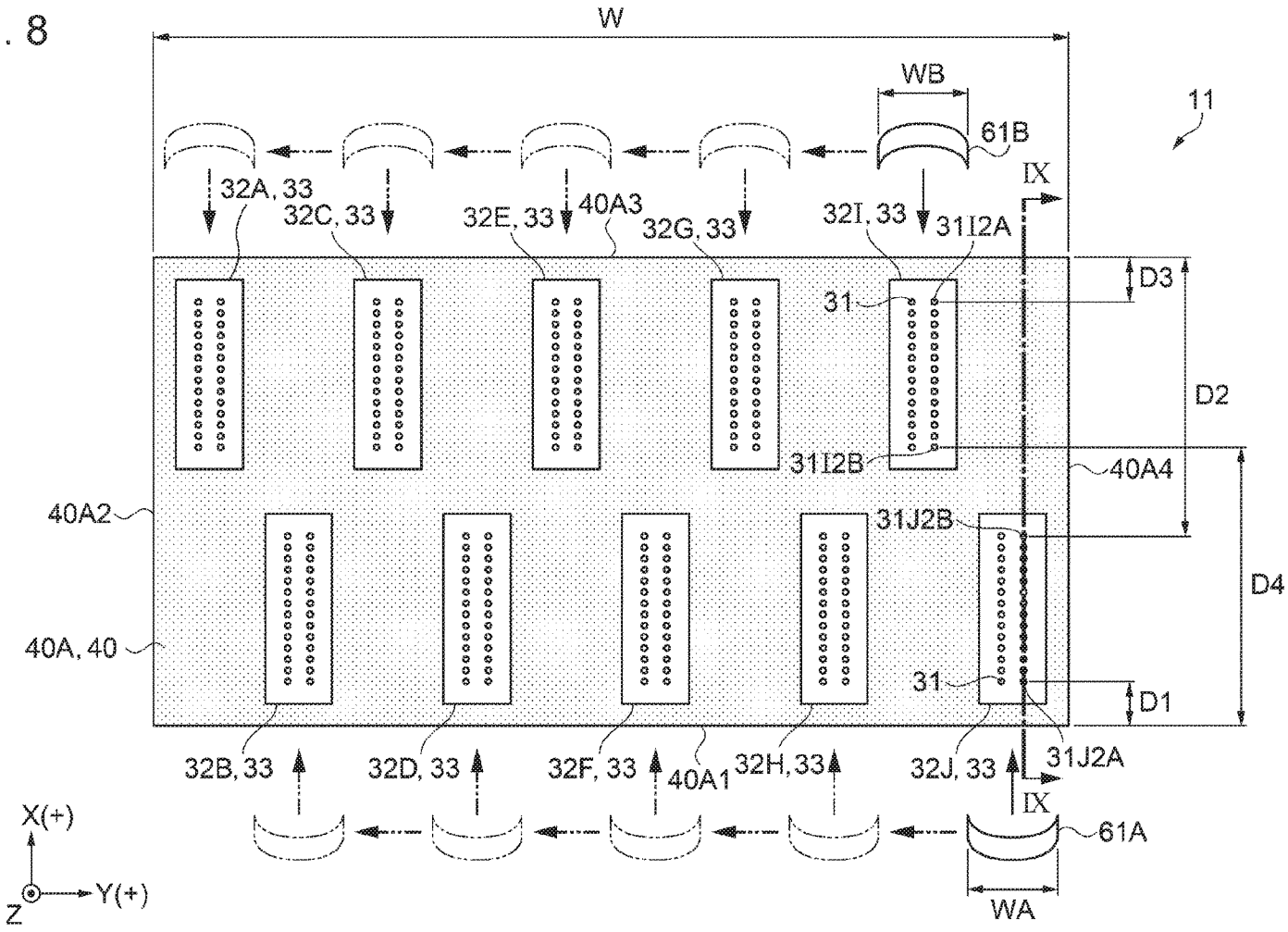
FIG. 8 is a plan view schematically illustrating a state of a wiping process.
Figure 9:
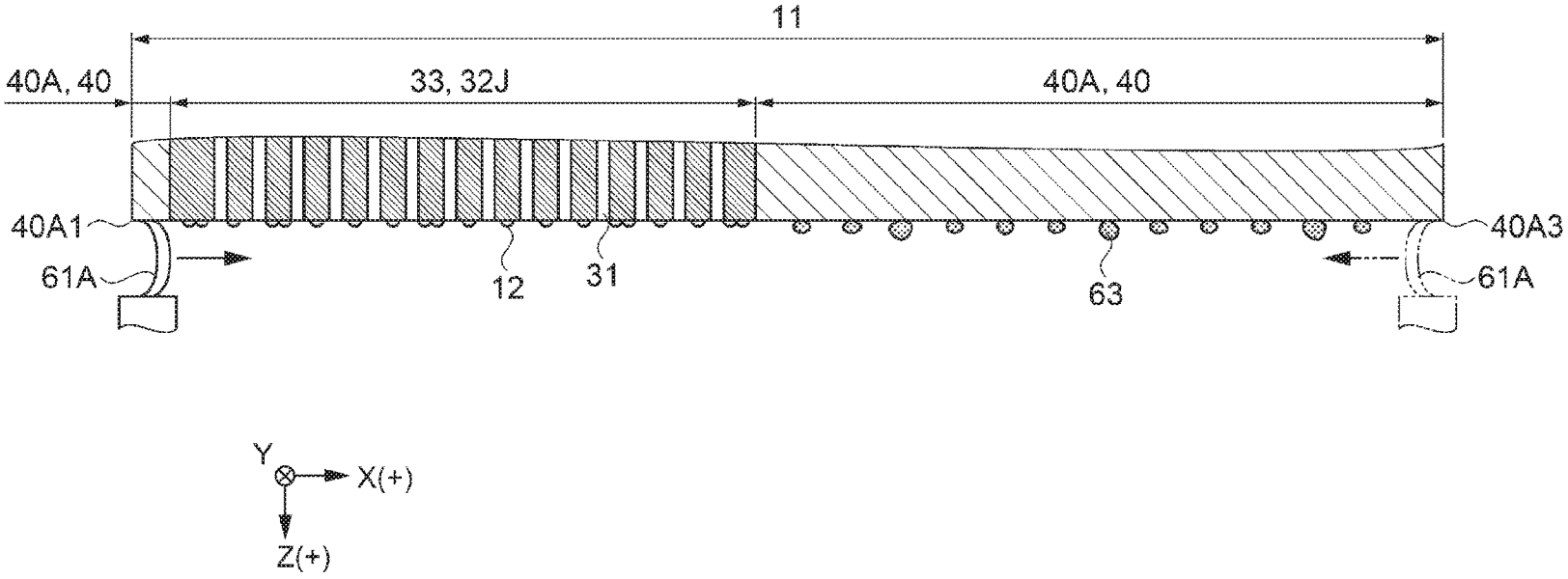
FIG. 9 is a schematic sectional view taken along line IX-IX in FIG. 8.

FIG. 8 is a view corresponding to FIG. 6, and is a plan view schematically illustrating a state of the wiping process. FIG. 9 is a schematic sectional view taken along line IX-IX in FIG. 8, and a view schematically illustrating a state of the wiping process.

As described above, in the printer 1, both of the ink droplet discharge operation in which the ink 12 is discharged as the ink droplets from the nozzles 31 of the recording head 10, and a transport operation of the recording medium are alternately repeated, and thereby a desired image is printed on the recording medium.

However, some ink droplets that are discharged from the nozzles 31 do not land on the recording medium, but float in the air as ink mist. The ink mist is attached to the front surface 40A of the fixing plate 40 or to the nozzle formed surface 33 of the nozzle plate 32 and stains the wiping surface 11. Further, dust or lint that floats around the recording head 10 is attached to the front surface 40A of the fixing plate 40 or to the nozzle formed surface 33 of the nozzle plate 32 and stains the wiping surface 11.

When the ink discharge operation is repeated, the ink mists (ink 12), in which dust or lint is mixed, are accumulated on the wiping surface 11 as a stain 63 (refer to FIG. 9). When the stains 63 are accumulated on the wiping surface 11 (especially, the nozzle formed surface 33), uniformity of the ink discharge performance of the recording head 10 is degraded and thus, a quality of an image that is printed on the recording medium is degraded. Therefore, in the printer 1, a flushing process or the wiping process, in which the stains 63 accumulated on the wiping surface 11 are removed, is regularly performed, and the recording head 10 returns to a normal state.

In the flushing process, the ink 12, of which the properties are degraded (the ink 12 subjected to a viscosity increase or the ink 12 into which bubbles are mixed), is forced to be emitted from the nozzles 31 of the recording head 10. Further, in the flushing process, the ink 12, of which the properties are not degraded, is also discharged, in addition to the ink 12 of which the properties are degraded. Further, the stains 63 attached to the nozzle formed surface 33 are removed along with the ink 12 that is forced to be discharged from the nozzles 31. Therefore, after the flushing process is ended, the ink 12, of which the properties are not degraded, is attached on the nozzle formed surface 33.

The wiping process is performed after the flushing process, the wiping surface 11 is wiped with the wiper 61, and the stains 63 attached on the front surface 40A of the fixing plate 40 or the ink 12 attached to the nozzle formed surface 33, of which the properties are not degraded, are removed.

Through the flushing process and the wiping process, the recording head 10 returns to the normal state, the recording head 10 performs a normal operation, and defective printing by the printer 1 is reduced.

The wiping process according to the embodiment is described in detail with reference to FIGS. 8 and 9, because the recording head 10 is well configured to return to a more appropriate state.

In FIG. 8, for easy understanding of the state of the wiping process, the wiping surface 11 (the front surface 40A of the fixing plate 40 and the nozzle formed surfaces 33 of the nozzle plates 32), the wipers 61A and 61B are illustrated, and the other components are omitted. Further, an arrow represents a moving direction of the wipers 61A and 61B with respect to the wiping surface 11.

Further, in FIG. 8, reference sign 31J2A is assigned to the nozzle 31 disposed to be closest to the side 40A1 in the nozzle plate 32J, and reference sign 31J2B is assigned to the nozzle 31 disposed to be farthest from the side 40A1. Reference sign 31I2A is assigned to the nozzle 31 disposed to be closest to the side 40A3 in the nozzle plate 32I, and reference sign 31I2B is assigned to the nozzle 31 disposed to be farthest from the side 40A3.

In the following description, the nozzle plate 32J is an example of a "first nozzle plate" and the nozzle plate 32I is an example of a "second nozzle plate". The moving direction (X(+) direction) of the first wiper 61A represented by an arrow in FIG. 8 and the moving direction (X(−) direction) of the second wiper 61B represented by an arrow in FIG. 8 are examples of a "moving direction of a wiper with respect to the wiping surface".

The side 40A1 is an example of an "edge on the upstream side in the moving direction" and an "edge of the wiping surface on a side closer to the nozzle region" in the moving direction (X(+) direction) of the first wiper 61A with respect to the wiping surface 11. The side 40A3 is an example of an "edge on the downstream side in the moving direction" and an "edge of the wiping surface on a side farther from the nozzle region". Further, the nozzle 31J2A is an example of a "nozzle disposed on the upstream side", and the nozzle 31J2B is an example of a "nozzle disposed on the downstream side".

The side 40A3 is an example of an "edge on the upstream side in the moving direction" and an "edge of the wiping surface on a side closer to the nozzle region" in the moving direction (X(−) direction) of the second wiper 61B with respect to the wiping surface 11. The side 40A1 is an example of an "edge on the downstream side in the moving direction" and an "edge of the wiping surface on a side farther from the nozzle region". Further, the nozzle 32I2A is an example of a "nozzle disposed on the upstream side", and the nozzle 31I2B is an example of a "nozzle disposed on the downstream side".

As illustrated in FIG. 8, a distance D1 between the side 40A1 and the nozzle 31J2A is shorter than a distance D2 between the side 40A3 and the nozzle 31J2B. Further, a distance D3 between the side 40A3 and the nozzle 31I2A is shorter than a distance D4 between the side 40A1 and the nozzle 31I2B.

Note that the distance D1 and the distance D3 are examples of a "distance between an edge of the wiping surface on the upstream side in the moving direction and a nozzle disposed on the upstream side". The distance D2 and the distance D4 are examples of a "distance between an edge of the wiping surface on the downstream side in the moving direction and a nozzle disposed on the downstream side".

In the first wiping process, the first wiper 61A moves in the X(+) direction with respect to the wiping surface 11 and wipes the nozzle formed surface 33 of the nozzle plate 32J. The second wiper 61B moves in the X(−) direction with respect to the wiping surface 11 and wipes the nozzle formed surface 33 of the nozzle plate 32I.

In other words, the wiping surface 11 have the first nozzle plate (nozzle plate 32J) and the second nozzle plate (nozzle plate 32I) in which the nozzles 31 are formed, and the first wiper 61A wipes the first nozzle plate (nozzle plate 32J) and the second wiper 61B wipes the second nozzle plate (nozzle plate 32I).

In addition, the first wiper 61A first comes into contact with the side 40A1 of the wiping surface 11, moves in the X(+) direction with respect to the wiping surface 11, and then is separated from the side 40A3 of the wiping surface 11. The second wiper 61B first comes into contact with the side 40A3 of the wiping surface 11, moves in the X(−) direction with respect to the wiping surface 11, and then is separated from the side 40A1 of the wiping surface 11.

The "edge of the wiping surface on the upstream side in the moving direction" in the application corresponds to a portion of the wiping surface 11 with which the wiper 61 first comes into contact. The "edge of the wiping surface on the downstream side in the moving direction" in the application corresponds to a portion of the wiping surface 11 from which the wiper 61 is separated.

Since the first wiper 61A first comes into contact with the side 40A1 of the wiping surface 11 in the moving direction of the first wiper 61A with respect to the wiping surface 11, the side 40A1 corresponds to the "edge on the upstream side". For example, in a case where the first wiper 61A first comes into contact with a region between the side 40A1 of the front surface 40A and the nozzle plate 32J, the "edge on the upstream side" is disposed in a region between the side 40A1 of the front surface 40A and the nozzle plate 32J.

Since the first wiper 61A is separated from the side 40A3 of the wiping surface 11 in the moving direction of the first wiper 61A with respect to the wiping surface 11, the side 40A3 corresponds to the "edge on the downstream side". For example, in a case where the first wiper 61A is separated from a region between the side 40A3 of the front surface 40A and the nozzle plate 32J, the "edge on the downstream side" is disposed in a region between the side 40A3 of the front surface 40A and the nozzle plate 32J.

Since the second wiper 61B first comes into contact with the side 40A3 of the wiping surface 11 in the moving direction of the second wiper 61B with respect to the wiping surface 11, the side 40A3 corresponds to the "edge on the upstream side". For example, in a case where the second wiper 61B first comes into contact with a region between the side 40A3 of the front surface 40A and the nozzle plate 32I, the "edge on the upstream side" is disposed in a region between the side 40A3 of the front surface 40A and the nozzle plate 32I.

Since the second wiper 61B is separated from the side 40A1 of the wiping surface 11 in the moving direction of the second wiper 61B with respect to the wiping surface 11, the side 40A1 corresponds to the "edge on the downstream side". For example, in a case where the second wiper 61B is separated from a region between the side 40A1 of the front surface 40A and the nozzle plate 32I, the "edge on the downstream side" is disposed in a region between the side 40A1 of the front surface 40A and the nozzle plate 32I.

The wiping surface 11 have the first nozzle plate (nozzle plate 32J) and the second nozzle plate (nozzle plate 32I) in which the nozzles 31 are formed, and the wiper 61 includes the first wiper 61A that wipes the first nozzle plate (nozzle plate 32J) and the second wiper 61B that wipes the second nozzle plate (nozzle plate 32I).

In the first wiping process, the first wiper 61A is caused to move in the moving direction of the first wiper 61A with respect to the wiping surface 11, in the state in which the distance D1 between the edge (side 40A1) of the wiping surface 11 on the upstream side in the moving direction and the nozzle 31J2A disposed on the upstream side is shorter than the distance D2 between the edge (side 40A3) of the wiping surface 11 on the downstream side in the moving direction and the nozzle 31J2B disposed on the downstream side, and the first wiper wipes the wiping surface 11.

Further, the second wiper 61B is caused to move in the moving direction of the second wiper 61B with respect to the wiping surface 11, in the state in which the distance D3 between the edge (side 40A3) of the wiping surface 11 on the upstream side in the moving direction and the nozzle 31I2A disposed on the upstream side is shorter than the distance D4 between the edge (side 40A1) of the wiping surface 11 on the downstream side in the moving direction and the nozzle 31I2B disposed on the downstream side, and the second wiper wipes the wiping surface 11.

In other words, in a wiping method of the recording head 10 in the first wiping process, the first wiper 61A is caused to move in a direction from the edge (side 40A1) of the wiping surface 11 which is closer to the nozzle region (nozzle plate 32J) toward the edge (side 40A3) of the wiping surface 11 which is farther from the nozzle region (nozzle plate 32J), and the first wiper wipes the wiping surface 11.

Further, the second wiper 61B is caused to move in a direction from the edge (side 40A3) of the wiping surface 11 which is closer to the nozzle region (nozzle plate 32I) toward the edge (side 40A1) of the wiping surface 11 which is farther from the nozzle region (nozzle plate 32I), and the second wiper wipes the wiping surface 11.

In the next wiping process, as illustrated with an arrow having a two-dot chain line in FIG. 8, the first wiper 61A is caused to move in the Y(−) direction and the nozzle formed surface 33 of the nozzle plate 32H is wiped with the first wiper 61A. The second wiper 61B is caused to move in the Y(−) direction and the nozzle formed surface 33 of the nozzle plate 32G is wiped with the second wiper 61B.

In the next wiping process, as illustrated with an arrow having a two-dot chain line in FIG. 8, the first wiper 61A is caused to move in the Y(−) direction and the nozzle formed surface 33 of the nozzle plate 32F is wiped with the first wiper 61A. The second wiper 61B is caused to move in the Y(−) direction and the nozzle formed surface 33 of the nozzle plate 32E is wiped with the second wiper 61B.

In the next wiping process, as illustrated with an arrow having a two-dot chain line in FIG. 8, the first wiper 61A is caused to move in the Y(−) direction and the nozzle formed surface 33 of the nozzle plate 32D is wiped with the first wiper 61A. The second wiper 61B is caused to move in the Y(−) direction and the nozzle formed surface 33 of the nozzle plate 32C is wiped with the second wiper 61B.

In the final wiping process, as illustrated with an arrow having a two-dot chain line in FIG. 8, the first wiper 61A is caused to move in the Y(−) direction and the nozzle formed surface 33 of the nozzle plate 32B is wiped with the first wiper 61A. The second wiper 61B is caused to move in the Y(−) direction and the nozzle formed surface 33 of the nozzle plate 32A is wiped with the second wiper 61B.

The wiping methods in the next wiping processes and the final wiping process are the same as the wiping method in the first wiping process.

Hence, in the wiping method of the recording head 10 according to the embodiment, the wiping surface 11 has the plurality of nozzle plates 32 in which the nozzles 31 are formed, and the nozzle plates 32 are arranged in the zigzag pattern. The nozzle plates 32 are arranged at positions which are closer to the edge of the wiping surface 11 on the upstream side than the edge of the wiping surface 11 on the downstream side in the moving direction of the wiper 61 with respect to the wiping surface 11. The wiper 61 is caused to move in the direction from the edge of the wiping surface 11 on the upstream side toward the edge of the wiping surface 11 on the downstream side, and the wiping surface 11 is wiped.

Note that the wiping method according to the embodiment described above is not limited to the application to the water-based ink (ink 12) containing the aqueous solvent, and it is possible to apply to another ink such as a non-aqueous that does not contain the aqueous solvent but contains an organic solvent.

As described above, since the glycerin content rates of the inks 12 that are discharged from the nozzle plates 32 are decreased in the order from the nozzle plate 32B, the nozzle plate 32D, the nozzle plate 32F, the nozzle plate 32H, to the nozzle plate 32J, the first wiper 61A wipes the nozzles 31 which discharge the ink 12 having the low glycerin content rate, and then wipes the nozzles 31 from which the ink 12 having the high glycerin content rate is discharged.

Further, since the glycerin content rates of the inks 12 that are discharged from the nozzle plates 32 are decreased in the order from the nozzle plate 32A, the nozzle plate 32C, the nozzle plate 32E, the nozzle plate 32G, to the nozzle plate 32I, the second wiper 61B wipes the nozzles 31 which discharge the ink 12 having the low glycerin content rate, and then wipes the nozzles 31 from which the ink 12 having the high glycerin content rate is discharged.

As described above, the embodiment has a configuration in which the wiper 61 wipes the nozzles 31 which discharge the ink 12 having the low humectant (glycerin) content rate of the inks 12, and then wipes the nozzles 31 that discharge the ink 12 having the high humectant (glycerin) content rate of the inks 12.

The first wiper 61A moves with respect to the wiping surface 11 at a speed which becomes slower in the order from the nozzle plate 32J, the nozzle plate 32H, the nozzle plate 32F, the nozzle plate 32D, the nozzle plate 32B, to the front surface 40A of the fixing plate 40. In other words, the first wiper 61A moves with respect to the wiping surface 11 at the speed which becomes slower on the side closer to the front surface 40A of the fixing plate 40 and becomes faster on the side closer to the nozzle plates 32.

Further, the second wiper 61B moves with respect to the wiping surface 11 at a speed which becomes slower in the order from the nozzle plate 32I, the nozzle plate 32G, the nozzle plate 32E, the nozzle plate 32C, the nozzle plate 32A, to the front surface 40A of the fixing plate 40. In other words, the second wiper 61B moves with respect to the wiping surface 11 at the speed which becomes slower on the side closer to the front surface 40A of the fixing plate 40 and becomes faster on the side closer to the nozzle plates 32.

As described above, the embodiment has a configuration in which the wiper 61 moves with respect to the wiping surface 11 at a slower speed in the region in which the front surface 40A of the fixing plate 40 is disposed than in the region in which the nozzles 31 are arranged.

Since the viscosity of the inks 12 that are discharged from the nozzle plates 32 is decreased in the order from the nozzle plate 32B, the nozzle plate 32D, the nozzle plate 32F, the nozzle plate 32H, to the nozzle plate 32J, the first wiper 61A moves with respect to the wiping surface 11 at a faster speed on the side closer to the nozzle plate 32 from which the ink 12 having the low viscosity is discharged, and at a slower speed on the side closer to the nozzle plate 32 from which the ink 12 having the high viscosity is discharged.

Further, since the viscosity of the inks 12 that are discharged from the nozzle plates 32 is decreased in the order from the nozzle plate 32A, the nozzle plate 32C, the nozzle plate 32E, the nozzle plate 32G, to the nozzle plate 32I, the second wiper 61B moves with respect to the wiping surface 11 at a faster speed on the side closer to the nozzle plate 32 from which the ink 12 having the low viscosity is discharged, and at a slower speed on the side closer to the nozzle plate 32 from which the ink 12 having the high viscosity is discharged.

As described above, the embodiment has a configuration in which the wiper 61 moves with respect to the wiping surface 11 at the slower speed on the nozzle plate 32 side in which the nozzles 31 that discharge the ink 12 having the high viscosity of the inks 12 are formed than on the nozzle plate 32 side in which the nozzles 31 that discharge the ink 12 having the low viscosity of the inks 12 are formed.

Further, a length WA of the first wiper 61A in the Y direction and a length WB of the second wiper 61B in the Y direction are shorter than a length W of the wiping surface 11 in the Y direction.

Note that the length WA of the first wiper 61A in the Y direction and the length WB of the second wiper 61B in the Y direction are examples of a "length of the wiper in a direction intersecting with the moving direction". The length W of the wiping surface 11 in the Y direction is an example of a "length of the wiping surface in the direction intersecting with the moving direction".

Since the length WA of the first wiper 61A in the Y direction and the length WB of the second wiper 61B in the Y direction are shorter than the length W of the wiping surface 11 in the Y direction, the first wiper 61A and the second wiper 61B moves from the edge of the wiping surface 11 on the upstream side to the edge of the wiping surface 11 on the downstream side a plurality of times, and the entire wiping surface 11 is wiped.

Specifically, the first wiper 61A moves in the X(+) direction five times and wipes the wiping surface 11. The second wiper 61B moves in the X(−) direction five times and wipes the wiping surface 11.

For example, when the length WA of the first wiper 61A in the Y direction is longer than the length W of the wiping surface 11 in the Y direction, the first wiper 61A can wipe the entire wiping surface 11 through the wiping process performed once.

Since appropriate conditions of the wiping process vary depending on the glycerin content rate (viscosity) of the ink 12 or the presence or absence of the nozzles 31, there are regions on the wiping surface 11, on which different appropriate wiping processes need to be performed. Therefore, it is preferable that the wiping surface 11 be wiped a plurality of times such that appropriate wiping processes are performed on the regions on which different appropriate wiping processes need to be performed.

FIG. 9 is a schematic sectional view taken along line IX-IX in FIG. 8, and a view schematically illustrating a state of the first wiping process by using the first wiper. In FIG. 9, for easy understanding of the state of the wiping process, a gap between the fixing plate 40 and the nozzle plate 32J is omitted.

As illustrated in FIG. 9, the stains 63 are attached to the front surface 40A of the fixing plate 40. For example, the stains 63 are the ink 12 (ink 12 from which the solvent component is evaporated) in which dust or lint is mixed and which is subjected to the viscosity increase.

The number of attachment of the stains 63 to the front surface 40A of the fixing plate 40 is proportional to an area of the front surface 40A of the fixing plate 40. Since an area of the front surface 40A which is disposed between the side 40A3 and the nozzle plate 32J is broader than an area of the front surface 40A which is disposed between the side 40A1 and the nozzle plate 32J, the number of attachment of the stains 63 is larger on the front surface 40A side which is disposed between the 40A3 and the nozzle plate 32J, and is smaller on the front surface 40A side which is disposed between the 40A1 and the nozzle plate 32J.

As described above, the stains 63 are removed from the nozzle formed surface 33 of the nozzle plate 32J through the flushing process and the ink 12 (ink 12 which is not subjected to the viscosity increase), of which the properties are not degraded, is attached to the nozzle formed surface 33 of the nozzle plate 32J.

In the first wiping process, the first wiper 61A is caused to move in the direction (X(+) direction) from the side 40A1 toward the side 40A3, and removes the stains 63 attached to the front surface 40A of the fixing plate 40 and the ink 12 which is attached to the nozzle formed surface 33 of the nozzle plate 32J and is not subjected to the viscosity increase. In other words, in the first wiping process, the first wiper 61A is caused to move from a side, on which a small amount of the stains 63 is attached to the front surface 40A of the fixing plate 40, toward a side, on which a large amount of the stains 63 is attached to the front surface 40A of the fixing plate 40, the first wiper removes the stains 63 attached to the front surface 40A of the fixing plate 40 and the ink 12 which is attached to the nozzle formed surface 33 of the nozzle plate 32J and is not subjected to the viscosity increase.

As illustrated in the two-dot chain line in FIG. 9, when the first wiper 61A is caused to move in a direction from the side, on which the large amount of the stains 63 is attached to the front surface 40A of the fixing plate 40, toward the side, on which the small amount of the stains 63 is attached to the front surface 40A of the fixing plate 40, the stains 63 move along with the first wiper 61A. Therefore, there is a concern that a problem will arise in that the stains 63 will be rubbed into the nozzles 31 of the nozzle plate 32J and the inks 12 are not normally discharged from the nozzles 31.

On the other hand, when the first wiper 61A is caused to move in a direction from the side, on which the small amount of the stains 63 is attached to the front surface 40A of the fixing plate 40, toward the side, on which the large amount of the stains 63 is attached to the front surface 40A of the fixing plate 40, a small amount of the stains 63 moves along with the first wiper 61A. Therefore, the stains 63 are not likely to be rubbed into the nozzles 31 of the nozzle plate 32J and the problem of abnormal discharge of the inks 12 from the nozzles 31 is not likely to arise.

Hence, it is preferable that the first wiper 61A be caused to move in the direction from the edge (side 40A1) of the wiping surface 11 which is closer to the nozzle region (nozzle plate 32J) toward the edge (side 40A3) of the wiping surface 11 which is farther from the nozzle region (nozzle plate 32J), and the first wiper 61A remove the stains 63 attached to the wiping surface 11.

In other words, it is preferable that the first wiper 61A be caused to move with respect to the wiping surface 11 in the moving direction of the first wiper 61A with respect to the wiping surface 11, in the state in which the distance D1 between the edge (side 40A1) of the wiping surface 11 on the upstream side in the moving direction and the nozzle 31J2A disposed on the upstream side is shorter than the distance D2 between the edge (side 40A3) of the wiping surface 11 on the downstream side in the moving direction and the nozzle 31J2B disposed on the downstream side, and the first wiper 61A remove the stains 63 attached to the wiping surface 11.

Further, the stains 63 (ink 12 subjected to the viscosity increase) attached to the front surface 40A of the fixing plate 40 are firmly attached, compared to the ink 12 which is attached to the nozzle formed surface 33 of the nozzle plate 32J and is not subjected to the viscosity increase. The ink 12, which is attached to the nozzle formed surface 33 of the nozzle plate 32J and is not subjected to the viscosity increase, is loosely attached, compared to the stains 63 (ink 12 subjected to the viscosity increase) attached to the front surface 40A of the fixing plate 40.

Therefore, the stains 63 need to be strongly wiped, the wiper 61 need to have a high capability of removing the stains, and the stains 63 need to be removes from the front surface 40A of the fixing plate 40. On the other hand, it is possible to remove the ink 12, which is not subjected to the viscosity increase, from the nozzle formed surface 33 of the nozzle plate 32J, even when the wiping is weakly performed (even when the wiper 61 has a low capability of removing the stains).

As described above, in the wiping process, while the wiper 61 applies the uniform wiping force to the wiping surface 11, the wiper 61 is caused to move with respect to the wiping surface 11. The strong wiping mean that the wiping force is applied for a long time, and when the wiping force is applied for a long time, the capability of the wiper 61 of removing the stains (stains 63 or the ink 12) is increased. The weak wiping mean that the wiping force is applied for a short time, and when the wiping force is applied for a short time, the capability of the wiper 61 of removing the stains (stains 63 or the ink 12) is decreased.

Therefore, in the embodiment, the first wiper 61A moves with respect to the wiping surface 11 at the slower speed on the side closer to the front surface 40A of the fixing plate 40 than on the side closer to the nozzle plates 32, the wiping force is applied for a long time, and the stains 63 firmly attached to the front surface 40A of the fixing plate 40 is removed.

Hence, it is preferable that the first wiper 61A move with respect to the wiping surface 11 at the slower speed on the side closer to the front surface 40A of the fixing plate 40 than on the side closer to the nozzle plates 32, and the wiping force be applied to the stains 63 attached to the front surface 40A of the fixing plate 40 for a long time. In other words, it is preferable that the first wiper 61A move with respect to the wiping surface 11 at a slower speed in a region (the front surface 40A of the fixing plate 40) in which no nozzles 31 are arranged, than in a region (the nozzle formed surfaces 33 of the nozzle plates 32) in which the nozzles 31 are arranged.

Further, in the embodiment, the first wiper 61A moves with respect to the wiping surface 11 at the faster speed on the side closer to the nozzle plates 32 than on the side closer to the front surface 40A of the fixing plate 40, the wiping force is applied for a short time, and the ink 12, which is weakly attached to the nozzle formed surface 33 of the nozzle plate 32J and is not subjected to the viscosity increase, is removed. As a result, the wiping is performed on the nozzle formed surface 33 of the nozzle plate 32J for a short time and it is possible to efficiently perform the wiping process.

Since the viscosity of the inks 12 that are discharged from the nozzle plates 32 is decreased in the order from the nozzle plate 32B, the nozzle plate 32D, the nozzle plate 32F, the nozzle plate 32H, to the nozzle plate 32J, the viscosity of the inks 12, which are attached to the nozzle formed surfaces 33 of the nozzle plates 32 and is not subjected to the viscosity increase, is also decreased in the order from the nozzle plate 32B, the nozzle plate 32D, the nozzle plate 32F, the nozzle plate 32H, to the nozzle plate 32J.

Since the ink 12 having the low viscosity is easy to flow, compared to the ink 12 having the high viscosity, it is possible to remove the ink from the nozzle formed surfaces 33 of the nozzle plates 32 even through weak wiping. Since the ink 12 having the high viscosity is difficult to flow, compared to the ink 12 having the low viscosity, the ink needs to be removed from the nozzle formed surfaces 33 of the nozzle plates 32 through strong wiping.

Therefore, it is preferable that the wiping force be applied to the ink 12 having the high viscosity for a long time, compared to the ink 12 having the low viscosity, and strong wiping be performed. Hence, it is preferable that the first wiper 61A move at the speed which becomes slower in the order from the nozzle plate 32J, the nozzle plate 32H, the nozzle plate 32F, the nozzle plate 32D, and the nozzle plate 32B.

In other words, it is preferable that the first wiper 61A move with respect to the wiping surface 11 at the slower speed on the nozzle plate 32 side in which the nozzles 31 that discharge the ink 12 having the high viscosity of the inks 12 are formed than on the nozzle plate 32 side in which the nozzles 31 that discharge the ink 12 having the low viscosity of the inks 12 are formed.

In addition, the first wiper 61A moves with respect to the wiping surface 11 at the faster speed on the side closer to the nozzle plate 32 in which the nozzles 31 that discharge the ink 12 having the low viscosity are formed, thereby, the wiping time is shortened, and it is possible to efficiently perform the wiping process.

As described above, the preferable wiping process and the reason thereof is described, as an example, with the first wiping process in which the first wiper 61A is used. Since the preferable wiping process and the reason described above is the same as the first wiping process, the next wiping process, and the final wiping process by using the second wiper 61B, the description thereof is omitted.

Embodiment 2

Figure 10:
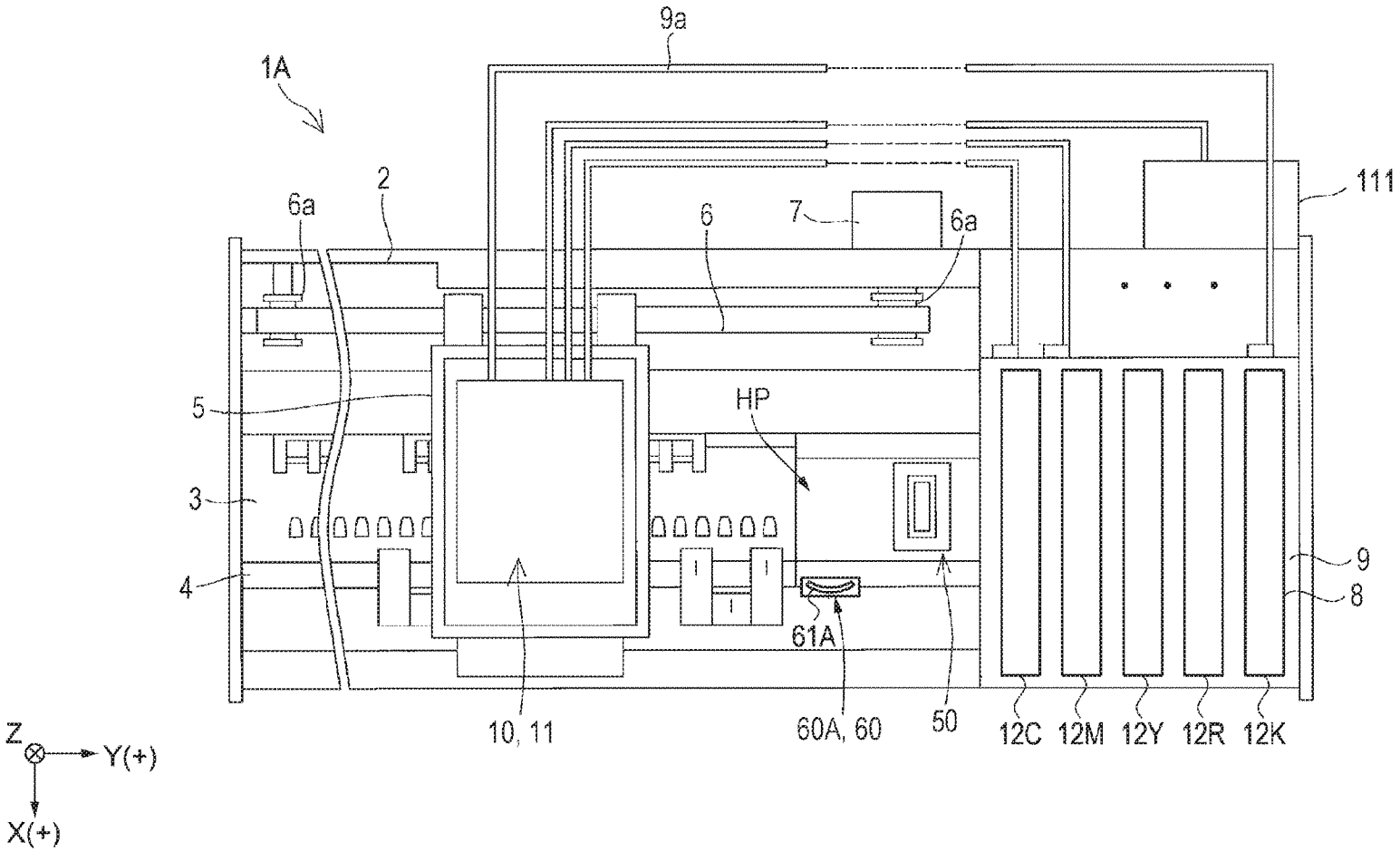
FIG. 10 is a plan view schematically illustrating a state of a printer according to Embodiment 2.
Figure 11:
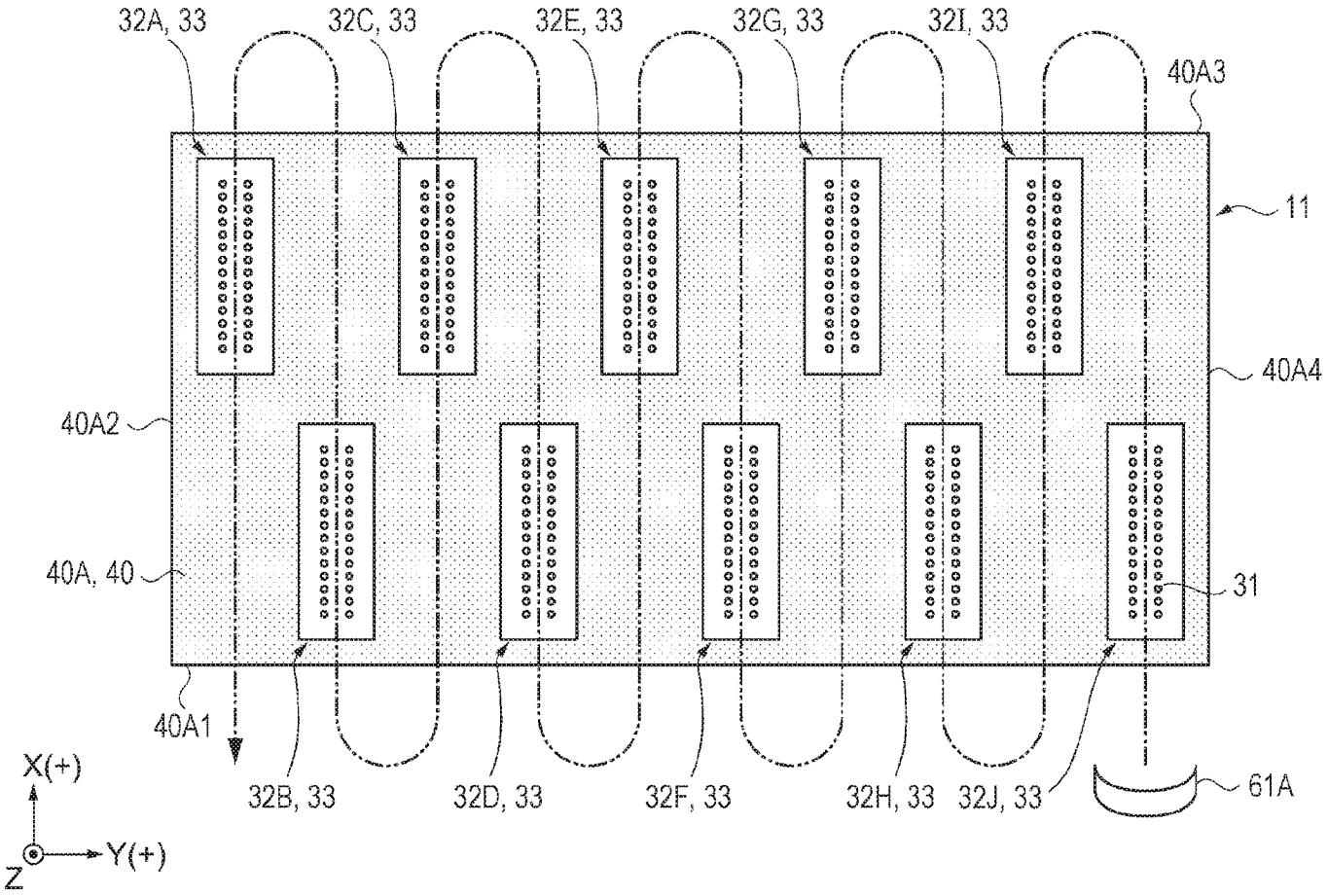
FIG. 11 is a plan view schematically illustrating a state of a wiping process.

FIG. 10 is a plan view schematically illustrating a state of a printer according to Embodiment 2. FIG. 11 is a view corresponding to FIG. 8, and is a plan view schematically illustrating the state of the wiping process.

The wiping portion 60 is provided at one position in the printer 1A according to the embodiment. The wiping portion 60 is provided at two positions in the printer 1 according to Embodiment 1. This is a difference between the embodiment and Embodiment 1.

Hereinafter, the printer 1A according to the embodiment is described by focusing on the differences from the printer 1 according to Embodiment 1, with reference to FIGS. 10 and 11. In addition, the same reference signs are assigned to the same components as those in Embodiment 1, and repeated description thereof is omitted.

As illustrated in FIG. 10, in the printer 1A according to the embodiment, the wiping portion 60 is provided on the X(+) direction side of the home position region HP. The wiping portion 60 has a wiper 61.

The carriage unit 122 is cable of causing the wiping surface 11 of recording head 10 to move to a predetermined position. The cleaning unit 126 is cable of causing the wiper 61 to move to a predetermined position. The wiper 61 is capable of moving in any directions with the cleaning unit 126, and is rotatable, the wiper moves with respect to the wiping surface 11 of the recording head 10 while the wiper causes the uniform wiping force to be applied such that the stains attached to the wiping surface 11 of the recording head 10 is removed.

As illustrated in FIG. 11, the wiper 61 moves in a direction represented by an arrow having two-dot chain line in FIG. 11, wipes in the order from the nozzle formed surface 33 of the nozzle plate 32J, the nozzle formed surface 33 of the nozzle plate 32I, the nozzle formed surface 33 of the nozzle plate 32H, the nozzle formed surface 33 of the nozzle plate 32G, the nozzle formed surface 33 of the nozzle plate 32F, the nozzle formed surface 33 of the nozzle plate 32E, the nozzle formed surface 33 of the nozzle plate 32D, the nozzle formed surface 33 of the nozzle plate 32C, the nozzle formed surface 33 of the nozzle plate 32B, and the nozzle formed surface 33 of the nozzle plate 32A.

Specifically, the wiper 61 wipes the nozzle formed surface 33 of the nozzle plate 32J and is reversed, and the wiper 61 wipes the nozzle formed surface 33 of the nozzle plate 32I and is reversed. Subsequently, the wiper 61 wipes the nozzle formed surface 33 of the nozzle plate 32H and is reversed, and the wiper 61 wipes the nozzle formed surface 33 of the nozzle plate 32G and is reversed. Subsequently, the wiper 61 wipes the nozzle formed surface 33 of the nozzle plate 32F and is reversed, and the wiper 61 wipes the nozzle formed surface 33 of the nozzle plate 32E and is reversed. Subsequently, the wiper 61 wipes the nozzle formed surface 33 of the nozzle plate 32D and is reversed, and the wiper 61 wipes the nozzle formed surface 33 of the nozzle plate 32C and is reversed. Subsequently, the wiper 61 wipes the nozzle formed surface 33 of the nozzle plate 32B and is reversed, and the wiper 61 wipes the nozzle formed surface 33 of the nozzle plate 32A and is reversed.

In the embodiment, the wiping surface 11 have the first nozzle plate (nozzle plate 32J) and the second nozzle plate (nozzle plate 32I) in which the nozzles 31 are formed, and the wiper 61 wipes the first nozzle plate (nozzle plate 32J), and then wipes the second nozzle plate (nozzle plate 32I).

In other words, in Embodiment 1, the wiping surface 11 have the first nozzle plate (nozzle plate 32J) and the second nozzle plate (nozzle plate 32I) in which the nozzles 31 are formed, and the first wiper 61A wipes the first nozzle plate (nozzle plate 32J) and the second wiper 61B wipes the second nozzle plate (nozzle plate 32I).

As described above, in the embodiment, one wiper 61 (one wiping portion 60) performs the wiping process and, in Embodiment 1, the two wipers 61A and 61B (two wiping portions 60) perform the wiping process. Hence, in the embodiment, a mechanism of a portion that performs the wiping is more simplified, compared to Embodiment 1, and the portion that performs the wiping can be produced in low costs and has a compact size.

In addition, in the embodiment, the wiping process is performed by the same wiping method as Embodiment 1. In other words, the wiper 61 is caused to move in the direction from the edge of the wiping surface 11 which is closer to the nozzle region (nozzle plate 32) toward the edge of the wiping surface 11 which is farther from the nozzle region (nozzle plate 32), and the wiper wipes the wiping surface 11.

In other words, the wiper 61 is caused to move with respect to the wiping surface 11 in the moving direction of the wiper 61 with respect to the wiping surface 11, in the state in which the distance between the edge of the wiping surface 11 on the upstream side in the moving direction and the nozzle 31 disposed on the upstream side is shorter than the distance between the edge of the wiping surface 11 on the downstream side in the moving direction and the nozzle 31 disposed on the downstream side, and the wiper wipes the wiping surface 11.

Further, the wiper 61 wipes the nozzles 31 which discharge the ink 12 having the low glycerin content rate, and then wipes the nozzles 31 which discharge the ink 12 having the high glycerin content rate.

Further, the wiping process is performed such that the wiper 61 moves with respect to the wiping surface 11 at a slower speed in the region (the front surface 40A of the fixing plate 40) in which no nozzles 31 are arranged, than in the region (the nozzle formed surfaces 33 of the nozzle plates 32) in which the nozzles 31 are arranged.

Further, the wiping process is performed such that the wiper 61 moves with respect to the wiping surface 11 at the slower speed on the nozzle plate 32 side in which the nozzles 31 that discharge the ink 12 having the high viscosity of the inks 12 are formed than on the nozzle plate 32 side in which the nozzles 31 that discharge the ink 12 having the low viscosity of the inks 12 are formed.

Embodiment 3

Figure 12:
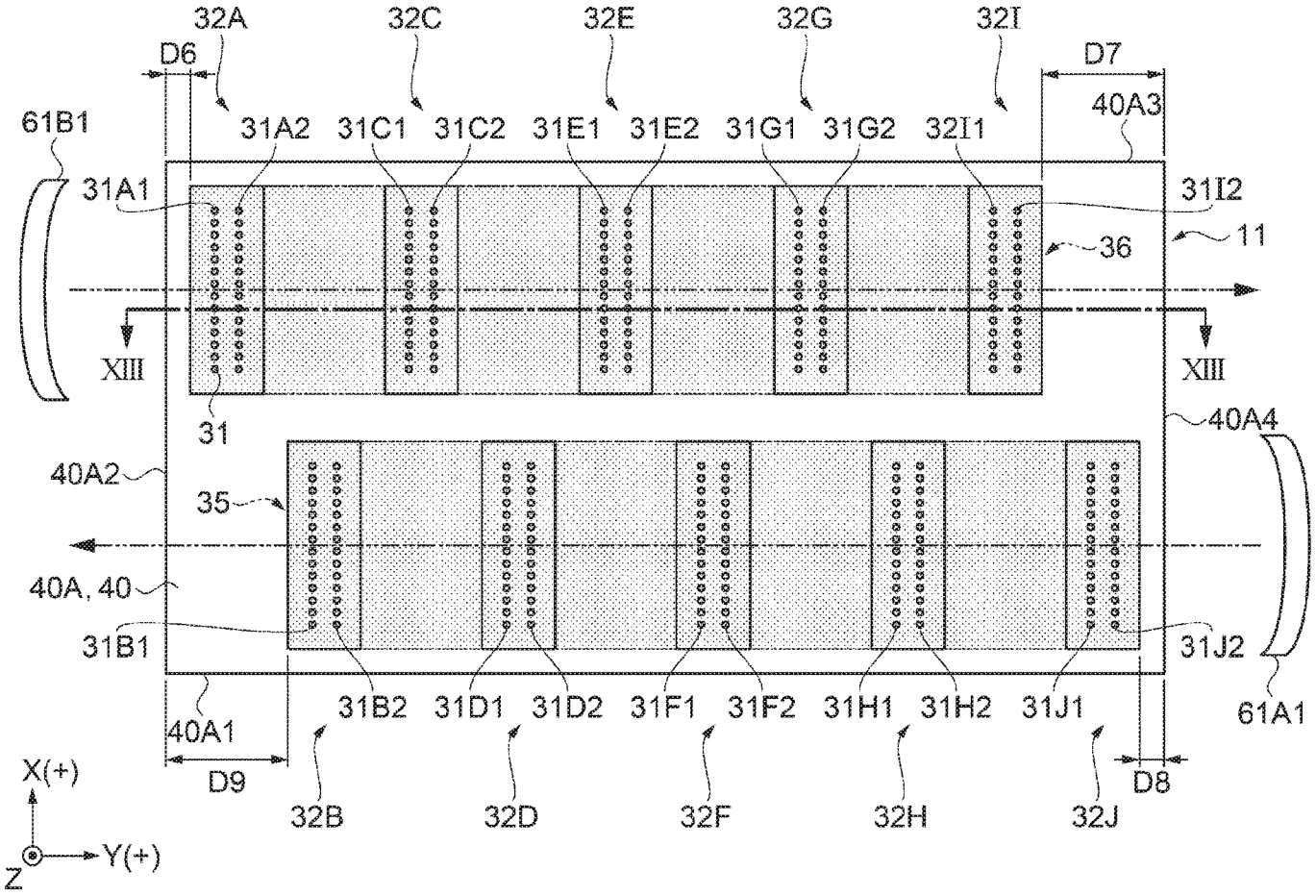
FIG. 12 is a plan view schematically illustrating a state of a wiping process of a printer according to Embodiment 3.
Figure 13:
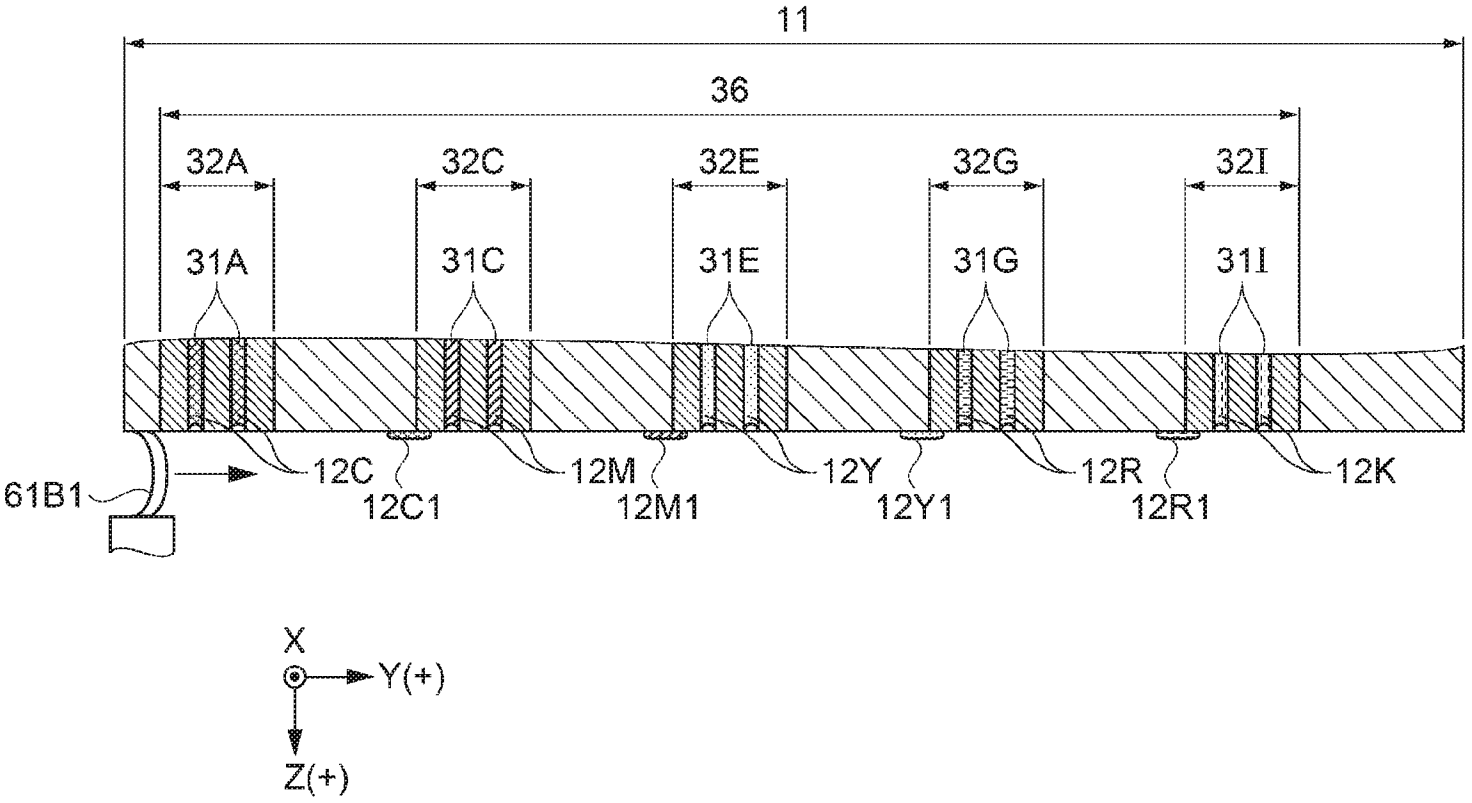
FIG. 13 is a schematic sectional view taken along line XIII-XIII in FIG. 12.

FIG. 12 is a view corresponding to FIG. 8, and is a plan view schematically illustrating the state of the wiping process in a printer according to Embodiment 3. FIG. 13 is a schematic sectional view taken along line XIII-XIII in FIG. 12.

In the printer according to the embodiment, the moving direction of the wiper 61 with respect to the wiping surface 11 is different from that in the printer 1 according to Embodiment 1. In other words, the embodiment differs from Embodiment 1 in that the wiper moves in the Y direction in the embodiment, and the wiper moves in the X direction in Embodiment 1.

Hereinafter, the wiping process of the printer according to the embodiment is described by focusing on the differences from the printer 1 according to Embodiment 1, with reference to FIGS. 12 and 13. In addition, the same reference signs are assigned to the same components as those in the embodiment 1, and repeated description thereof is omitted.

As illustrated in FIG. 12, on the wiping surface 11, a first nozzle plate group 35 in which the nozzle plate 32J, the nozzle plate 32H, the nozzle plate 32F, the nozzle plate 32D, and the nozzle plate 32B are arranged in this order in the Y(−) direction, and a second nozzle plate group 36 in which the nozzle plate 32A, the nozzle plate 32C, the nozzle plate 32E, the nozzle plate 32G, and the nozzle plate 32I are arranged in this order in the Y(+) direction, are disposed.

Further, the first wiper 61A1 moves in the Y(−) direction and wipes the first nozzle plate group 35. The second wiper 61B1 moves in the Y(+) direction and wipes the second nozzle plate group 36.

The first nozzle plate group 35 is disposed on the wiping surface 11 such that a distance D8 between the side 40A4 and the nozzle plate 32J is shorter than a distance D9 between the side 40A2 and the nozzle plate 32B. Further, the second nozzle plate group 36 is disposed on the wiping surface 11 such that a distance D6 between the side 40A2 and the nozzle plate 32A is shorter than a distance D7 between the side 40A4 and the nozzle plate 32I.

Note that, in the moving direction (Y(−) direction) of the first wiper 61A1 with respect to the wiping surface 11, the nozzle plate 32J is an example of the "first nozzle plate" and the nozzle plates 32H, 32F, 32D, and 32B are examples of the "second nozzle plate". Further, the side 40A4 is an example of the "edge on the upstream side in the moving direction". The side 40A2 is an example of the "edge on the downstream side in the moving direction".

Further, in the moving direction (Y(+) direction) of the second wiper 61B1 with respect to the wiping surface 11, the nozzle plate 32A is an example of the "first nozzle plate" and the nozzle plates 32C, 32E, 32G, and 32I are examples of the "second nozzle plate". Further, the side 40A2 is an example of the "edge on the upstream side in the moving direction". The side 40A4 is an example of the "edge on the downstream side in the moving direction".

The embodiment has a configuration in which the wiping surface 11 has the first nozzle plate group 35 including the first nozzle plate (nozzle plate 32J) and the second nozzle plates (nozzle plates 32H, 32F, 32D, and 32B) in which the nozzles 31 are formed and which are arranged in the moving direction (Y(−) direction) of the first wiper 61A1 with respect to the wiping surface 11, and the first nozzle plate group 35 is disposed at a position which is closer to the edge (side 40A4) of the wiping surface 11 on the upstream side than to the edge (side 40A2) of the wiping surface on the downstream side in the moving direction (Y(−) direction). In this configuration, the first wiper 61A1 wipes the first nozzle plate group 35 in the moving direction (Y(−) direction).

Further, the embodiment has a configuration in which the wiping surface 11 has the second nozzle plate group 36 including the first nozzle plate (nozzle plate 32A) and the second nozzle plates (nozzle plates 32C, 32E, 32G, and 32I) in which the nozzles 31 are formed and which are arranged in the moving direction (Y(+) direction) of the second wiper 61B1 with respect to the wiping surface 11, and the second nozzle plate group 36 is disposed at a position which is closer to the edge (side 40A2) of the wiping surface 11 on the upstream side than to the edge (side 40A4) of the wiping surface on the downstream side in the moving direction (Y(+) direction). In this configuration, the second wiper 61B1 wipes the second nozzle plate group 36 in the moving direction (Y(+) direction).

In the embodiment, widths of the wipers 61A1 and 61B1 (size of the wiper 61 in a direction intersecting with the moving direction) are larger than widths of the wipers 61A and 61B of Embodiment 1 (size of the wiper 61 in the direction intersecting with the moving direction). This is another difference between the embodiment and Embodiment 1.

The first wiper 61A1 moves with respect to the wiping surface 11 in the Y(−) direction and the nozzle plate 32J, the nozzle plate 32H, the nozzle plate 32F, the nozzle plate 32D, and the nozzle plate 32B are wiped in this order. In other words, the first wiper 61A1 moves with respect to the wiping surface 11 in the Y(−) direction once and wipes the wiping surface 11.

On the other hand, the first wiper 61A of Embodiment 1 moves in the X(+) direction five times and wipes the wiping surface 11.

The second wiper 61B1 moves with respect to the wiping surface 11 in the Y(+) direction and the nozzle plate 32A, the nozzle plate 32C, the nozzle plate 32E, the nozzle plate 32G, and the nozzle plate 32I are wiped in this order. In other words, the second wiper 61B1 moves with respect to the wiping surface 11 in the Y(+) direction once and wipes the wiping surface 11.

On the other hand, the second wiper 61B of Embodiment 1 moves in the X(−) direction five times and wipes the wiping surface 11.

Hence, in the embodiment, since the number of times the wiper 61 moves is smaller than Embodiment 1, it is possible to efficiently wipe the wiping surface 11.

The cyan (C) ink 12C is discharged from the nozzle plates 32A and 32B, the magenta (M) ink 12M is discharged from the nozzle plates 32C and 32D, the yellow (Y) ink 12Y is discharged from the nozzle plates 32E and 32F, the red (R) ink 12R is discharged from the nozzle plates 32G and 32H, and the black (K) ink 12K is discharged from the nozzle plates 32I and 32J. This is the same both in the embodiment and Embodiment 1.

The glycerin content rates of the inks 12 which are discharged from the first nozzle plate group 35 are decreased in the order from the cyan (C) ink 12C, the magenta (M) ink 12M, the yellow (Y) ink 12Y, the read red (R) ink 12R, to the black (K) ink 12K.

Hence, the glycerin content rates of the inks 12 which are discharged from the nozzle plates 32 are decreased in the order from the nozzle plate 32B, the nozzle plate 32D, the nozzle plate 32F, the nozzle plate 32H, to the nozzle plate 32J. This is the same both in the embodiment and Embodiment 1.

The glycerin content rates of the inks 12 which are discharged from the second nozzle plate group 36 are decreased in the order from the black (K) ink 12K, the read red (R) ink 12R, the yellow (Y) ink 12Y, the magenta (M) ink 12M, to the cyan (C) ink 12C.

Hence, the glycerin content rates of the inks 12 which are discharged from the nozzle plates 32 are decreased in the order from the nozzle plate 32I, the nozzle plate 32G, the nozzle plate 32E, the nozzle plate 32C, to the nozzle plate 32A. This is still another difference between the embodiment and Embodiment 1.

As described above, the first nozzle plate group 35 and the second nozzle plate group 36 discharge the inks 12 having different glycerin content rates even when the inks 12 have the same color. This is still another difference between the embodiment and Embodiment 1.

The first wiper 61A1 moves in the Y(−) direction and wipes the first nozzle plate group 35 in the order from the nozzle plate 32J, the nozzle plate 32H, the nozzle plate 32F, the nozzle plate 32D, to the nozzle plate 32B.

In other words, the first wiper 61A1 moves from the nozzle plate 32J that discharges the ink 12 having the lowest glycerin content rate toward the nozzle plate 32B that discharges the ink 12 having the highest glycerin content rate, and wipes the nozzle plate 32J, the nozzle plate 32H, the nozzle plate 32F, the nozzle plate 32D, and the nozzle plate 32B, in this order.

In other words, the first wiper 61A1 wipes the nozzles 31 which discharge the ink 12 having the low glycerin content rate of the inks 12, and then wipes the nozzles 31 which discharge the ink 12 having the high glycerin content rate of the inks 12.

The second wiper 61B1 moves in the Y(+) direction and wipes the second nozzle plate group 36 in the order from the nozzle plate 32A, the nozzle plate 32C, the nozzle plate 32E, the nozzle plate 32G, to the nozzle plate 32I.

In other words, the second wiper 61B1 moves from the nozzle plate 32A that discharges the ink 12 having the lowest glycerin content rate toward the nozzle plate 32I that discharges the ink 12 having the highest glycerin content rate, and wipes the nozzle plate 32A, the nozzle plate 32C, the nozzle plate 32E, the nozzle plate 32G, and the nozzle plate 32I, in this order.

In other words, the second wiper 61B1 wipes the nozzles 31 which discharge the ink 12 having the low glycerin content rate of the inks 12, and then wipes the nozzles 31 which discharge the ink 12 having the high glycerin content rate of the inks 12.

Next, with reference to FIG. 13, a reason why the wiping is performed on the nozzles 31 which discharge the ink 12 having the low glycerin content rate of the inks 12, and then on the nozzles 31 which discharge the ink 12 having the high glycerin content rate of the inks 12 is described with the case in which the second wiper 61B1 wipes the second nozzle plate group 36, as an example.

In the following description, the nozzles 31 of the nozzle arrays 31A1 and 31A2 in the nozzle plate 32A are referred to as nozzles 31A, the nozzles 31 of the nozzle arrays 31C1 and 31C2 in the nozzle plate 32C are referred to as nozzles 31C, the nozzles 31 of the nozzle arrays 31E1 and 31E2 in the nozzle plate 32E are referred to as nozzles 31E, the nozzles 31 of the nozzle arrays 31G1 and 31G2 in the nozzle plate 32G are referred to as nozzles 31G, and the nozzles 31 of the nozzle arrays 31I1 and 31I2 in the nozzle plate 32I are referred to as nozzles 31I.

As described above, since the flushing process is performed in the previous stage of the wiping process, in the previous stage of the wiping process, the ink 12C is attached to the nozzle formed surface 33 of the nozzle plate 32A, the ink 12M is attached to the nozzle formed surface 33 of the nozzle plate 32C, the ink 12Y is attached to the nozzle formed surface 33 of the nozzle plate 32E, the ink 12R is attached to the nozzle formed surface 33 of the nozzle plate 32G, the ink 12K is attached to the nozzle formed surface 33 of the nozzle plate 32I.

Therefore, the wiping is performed in the state in which the ink 12 is attached to the nozzle formed surface 33. Through the wiping process, the second wiper 61B1 removes most of the ink 12 attached to the nozzle formed surface 33, and a part of residues of the ink 12 attached to the nozzle formed surface 33 in the moving direction (Y(+) direction) of the second wiper 61B1 and are attached to a region on the downstream side in the moving direction (Y(+) direction) of the second wiper 61B1.

In other words, the remaining inks 12 due to the residue from the second wiper 61B1 are attached to the region on the downstream side in the moving direction (Y(+) direction) of the second wiper 61B1.

Therefore, as illustrated in FIG. 13, when the ink 12C attached to the nozzle formed surface 33 of the nozzle plate 32A is wiped, the remaining ink 12C as an ink residue 12C1 is attached to a region between the nozzles 31A and the nozzles 31C. When the ink 12M attached to the nozzle formed surface 33 of the nozzle plate 32C is wiped, the remaining ink 12M as an ink residue 12M1 is attached to a region between the nozzles 31C and the nozzles 31E. When the ink 12Y attached to the nozzle formed surface 33 of the nozzle plate 32E is wiped, the remaining ink 12Y as an ink residue 12Y1 is attached to a region between the nozzles 31E and the nozzles 31G. When the ink 12R attached to the nozzle formed surface 33 of the nozzle plate 32G is wiped, the remaining ink 12R as an ink residue 12R1 is attached to a region between the nozzles 31G and the nozzles 31I.

As a result, the ink residue 12C1 is positioned in the vicinity of the ink 12M with which the nozzles 31C are filled, the ink residue 12M1 is positioned in the vicinity of the ink 12Y with which the nozzles 31E are filled, the ink residue 12Y1 is positioned in the vicinity of the ink 12R with which the nozzles 31G are filled, and the ink residue 12R1 is positioned in the vicinity of the ink 12K with which the nozzles 31I are filled.

Note that the ink 12C and the ink residue 12C1, the ink 12M and the ink residue 12M1, the ink 12Y and the ink residue 12Y1, and the ink 12R and the ink residue 12R1 have substantially the same compositions, respectively. Therefore, the glycerin content rate is the same in the ink 12C and the ink residue 12C1, the ink 12M and the ink residue 12M1, the ink 12Y and the ink residue 12Y1, and the ink 12R and the ink residue 12R1.

Therefore, the glycerin content rates are increased in the order from the ink residue 12C1 (ink 12C), the ink residue 12M1 (ink 12M), the ink residue 12Y1 (ink 12Y), the ink residue 12R1 (ink 12R), to the ink 12K.

Hence, the ink residue 12C1 having the lower glycerin content rate than the ink 12M is positioned in the vicinity of the ink 12M with which the nozzles 31C are filled, the ink residue 12M1 having the lower glycerin content rate than the ink 12Y is positioned in the vicinity of the ink 12Y with which the nozzles 31E are filled, the ink residue 12Y1 having the lower glycerin content rate than the ink 12R is positioned in the vicinity of the ink 12R with which the nozzles 31G are filled, and the ink residue 12R1 having the lower glycerin content rate than the ink 12K is positioned in the vicinity of the ink 12K with which the nozzles 31I are filled.

As described above, in the embodiment, an ink residue having the lower glycerin content rate than the ink 12 is positioned in the vicinity of the corresponding ink 12 with which the nozzles 31 are filled.

In a case where the glycerin content rates are decreased in the order from the ink residue 12C1 (ink 12C), the ink residue 12M1 (ink 12M), the ink residue 12Y1 (ink 12Y), the ink residue 12R1 (ink 12R), to the ink 12K, the ink residue having the higher glycerin content rate than the ink 12 is positioned in the vicinity of the corresponding ink 12 with which the nozzles 31 are filled.

The glycerin has the hygroscopicity and is likely to absorb water.

The ink 12 having the high glycerin content rate is likely to absorb water and is likely to attract water, compared to the ink 12 having the low glycerin content rate. For example, when the ink 12 having the high glycerin content rate is positioned in the vicinity of the ink 12 having the low glycerin content rate, water moves from the ink 12 having the low glycerin content rate to the ink 12 having the high glycerin content rate.

Therefore, when the ink 12 having the high glycerin content rate is positioned in the vicinity of the ink 12 having the low glycerin content rate, the ink 12 having the high glycerin content rate attracts water in the ink 12 having the low glycerin content rate, the water (water concentration) in the ink 12 having the low glycerin content rate is reduced, and the viscosity of the ink 12 having the low glycerin content rate is increased.

For example, when the ink residue having the higher glycerin content rate than the ink 12 is positioned in the vicinity of the corresponding ink 12 with which the nozzles 31 are filled, water in the corresponding ink 12 is attracted to the ink residue having the higher glycerin content rate than the corresponding ink 12, the water in the corresponding ink 12 is reduced, the viscosity of the corresponding ink 12 is increased, and the corresponding ink 12 is difficult to be discharged from the nozzles 31.

Specifically, when the ink residue 12C1 having the higher glycerin content rate than the ink 12M is positioned in the vicinity of the corresponding ink 12M with which the nozzles 31C are filled, water in the ink 12M is attracted to the ink residue 12C1, the viscosity of the ink 12M is increased, and the ink 12M is difficult to be discharged from the nozzles 31C.

Since the ink residue 12C1 is unevenly attached to the nozzle formed surface 33 of the nozzle plate 32C, there are a portion in which the ink residue 12C1 is attached and a portion in which the ink residue 12C1 is not attached in the nozzle formed surface 33 of the nozzle plate 32C. Therefore, in the portion in which the ink residue 12C1 is attached, the viscosity of the ink 12M is increased and the ink 12M is difficult to be discharged from the nozzles 31C, compared to the portion in which the ink residue 12C1 is not attached. Therefore, a problem arises in that it is difficult to evenly discharge the ink 12M from the nozzle formed surface 33 of the nozzle plate 32C.

In the embodiment, since the ink residue 12C1 having the lower glycerin content rate than the ink 12M is positioned in the vicinity of the ink 12M with which the nozzles 31C are filled, water in the ink 12M is unlikely to be attracted to the ink residue 12C1. Therefore, a phenomenon, in which the water in the ink 12M is attracted to the ink residue 12C1 and the viscosity of the ink 12M is increased, does not occur.

On the other hand, since the ink 12M has the higher glycerin content rate than the ink residue 12C1, a phenomenon, in which the ink 12M attracts water in the ink residue 12C1, occurs. Since the ink residue 12C1 is a minute amount, compared to the ink 12M, a change in the water concentration in the ink 12M is minute and the viscosity of the ink 12M does not change even when the ink 12M attracts the water in the ink residue 12C1.

Accordingly, when the ink residue 12C1 having the lower glycerin content rate than the ink 12M is positioned in the vicinity of the ink 12M with which the nozzles 31C are filled, there occurs no phenomenon in which the viscosity of the ink 12M is increased in the portion to which the ink residue 12C1 is attached. Therefore, it is possible to reduce an occurrence of a problem arising in that it is difficult to evenly discharge the ink 12M from the nozzle formed surface 33 of the nozzle plate 32C.

Accordingly, it is preferable that the ink residue having the lower glycerin content rate than the ink 12 be positioned in the vicinity of the corresponding ink 12 with which the nozzles 31 are filled.

In the embodiment, the second wiper 61B1 moves from the nozzle plate 32A that discharges the ink 12 having the lowest glycerin content rate toward the nozzle plate 32I that discharges the ink 12 having the highest glycerin content rate, and wipes the nozzle plate 32A, the nozzle plate 32C, the nozzle plate 32E, the nozzle plate 32G, and the nozzle plate 32I, in this order. Accordingly, in the wiping process with the second wiper 61B1, the ink residue having the lower glycerin content rate than the ink 12 is positioned in the vicinity of the corresponding ink 12 with which the nozzles 31 are filled.

Hence, it is preferable that the second wiper 61B1 wipes the nozzles 31 which discharge the ink 12 having the low glycerin content rate of the inks 12, and then wipes the nozzles 31 which discharge the ink 12 having the high glycerin content rate of the inks 12.

Similarly, the first wiper 61A1 moves from the nozzle plate 32J that discharges the ink 12 having the lowest glycerin content rate toward the nozzle plate 32B that discharges the ink 12 having the highest glycerin content rate, and wipes the nozzle plate 32J, the nozzle plate 32H, the nozzle plate 32F, the nozzle plate 32D, and the nozzle plate 32B, in this order. Accordingly, in the wiping process with the first wiper 61A1, the ink residue having the lower glycerin content rate than the ink 12 is positioned in the vicinity of the corresponding ink 12 with which the nozzles 31 are filled.

Hence, it is preferable that the first wiper 61A1 wipes the nozzles 31 which discharge the ink 12 having the low glycerin content rate of the inks 12, and then wipes the nozzles 31 which discharge the ink 12 having the high glycerin content rate of the inks 12.

Embodiment 4

Figure 14:
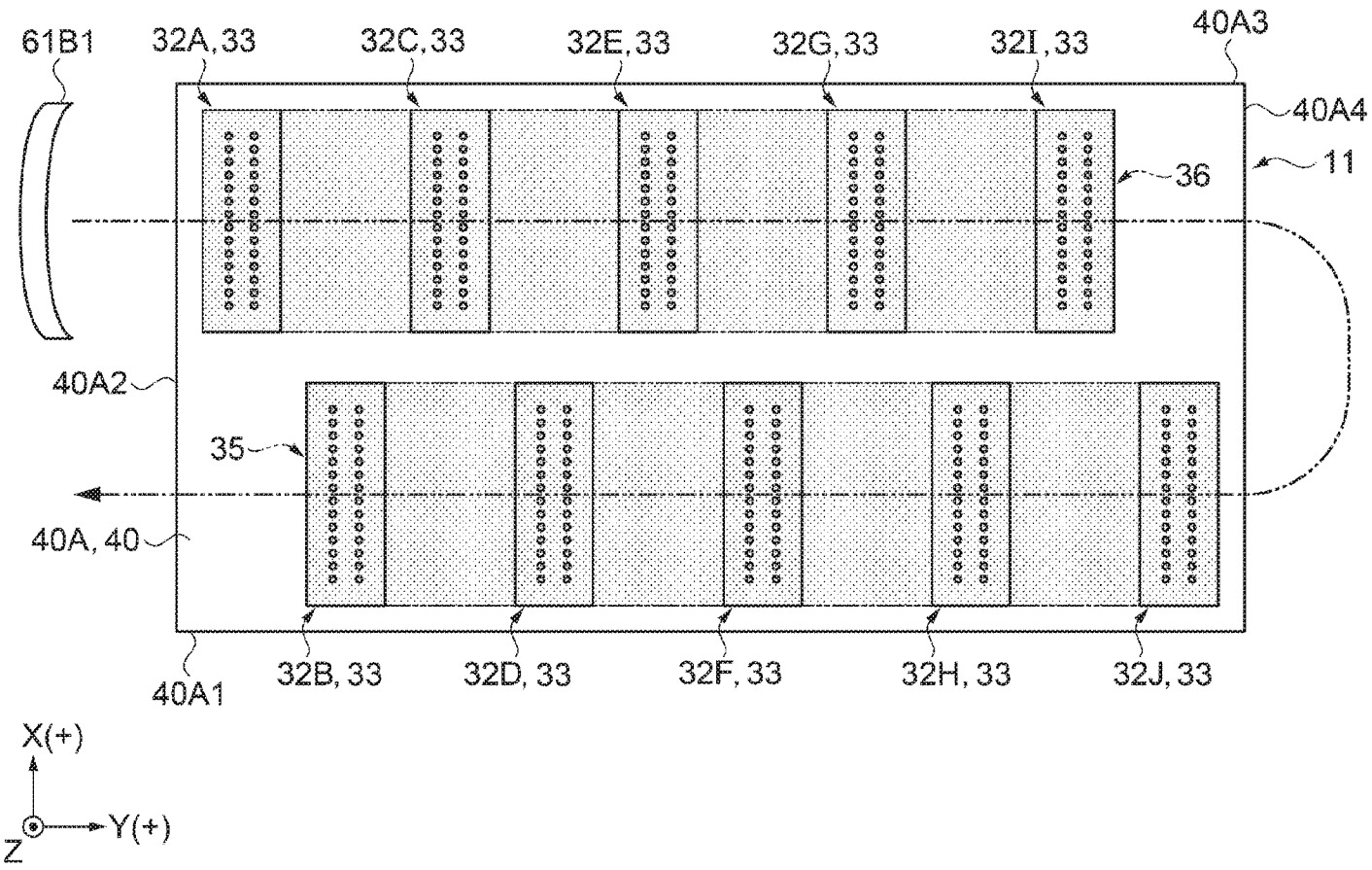
FIG. 14 is a plan view schematically illustrating a state of a wiping process of a printer according to Embodiment 4.

FIG. 14 is a view corresponding to FIG. 12, and is a plan view schematically illustrating the state of the wiping process in a printer according to Embodiment 4.

The wiping portion 60 is provided at one position in the printer according to the embodiment. The wiping portion 60 is provided at two positions in the printer according to Embodiment 3. This is a difference between the embodiment and Embodiment 3.

Hereinafter, the wiping process of the printer according to the embodiment is described by focusing on the differences from the printer according to Embodiment 3, with reference to FIG. 14. In addition, the same reference signs are assigned to the same components as those in the embodiment 3, and repeated description thereof is omitted.

As illustrated in FIG. 14, the printer according to the embodiment has one wiper 61B1. The wiper 61B1 moves in a direction represented by a two-dot chain line in FIG. 14, and wipes the wiping surface 11. In other words, the wiper 61B1 first moves in the Y(+) direction, wipes the second nozzle plate group 36, then is reversed to move in the Y(−) direction, and wipes the nozzle the first nozzle plate group 35.

In the embodiment, a mechanism of a portion that performs the wiping is more simplified, compared to Embodiment 3, and the portion that performs the wiping can be produced in low costs and has a compact size.

In the embodiment described above, it is important that the wiper (for example, the first wiper 61A) be caused to relatively move in a direction from the edge (for example, the side 40A1) of the wiping surface 11 which is closer to the nozzle region (for example, the nozzle plate 32J) toward the edge (for example, the side 40A3) of the wiping surface 11 which is farther from the nozzle region (nozzle plate 32J), and the wiper wipe the wiping surface 11. In other words, it is important that the wiper (for example, the first wiper 61A) be caused to relatively move from the side on which the small amount of stains 63 is attached to the front surface 40A of the fixing plate 40, to the side on which a large amount of the stains 63 is attached to the front surface 40A of the fixing plate 40, and the wiper wipe the wiping surface 11.

In this configuration, the stains 63 are unlikely to be rubbed into the nozzles 31 of the nozzle plate 32J, and the recording head 10 can return to a more appropriate state.

Further, in the configuration, the ink 12 may contain the humectant or may not contain the humectant. The viscosity of the inks 12 may the same or may be different from each other.

Further, the wiper may move from the edge of the wiping surface 11 on the upstream side to the edge of the wiping surface 11 on the downstream side a plurality of times so as to wipe the entire wiping surface 11, or may move once and wipe the entire wiping surface 11.

Further, the length of the wiper 61 in the Y direction may be equal to the length W of the wiping surface 11 in the Y direction, or the length of the wiper 61 in the Y direction may be longer than the length W of the wiping surface 11 in the Y direction.

Further, one wiping portion 60 may be provided or two or a plurality of wiping portions 60 may be provided. Further, one wiper 61 may be provided or two or a plurality of wipers 61 may be provided.

Further, the wiping surface 11 may be configured to have one nozzle plate 32 or may be configured to have a plurality of nozzle plates 32. In addition, in a case where the wiping surface 11 has the plurality of nozzle plates 32, the nozzle plates 32 may be positioned in the zigzag pattern or may be positioned in any pattern other than the zigzag pattern.

Further, the wiper 61 may move at the same speed or at different speeds with respect to the nozzle plates 32 that discharge the inks 12 having the viscosity and the nozzle plates 32 that discharge the inks 12 having the high viscosity. Further, the wiper 61 may move at the same speed or at different speeds on the side closer to the front surface 40A of the fixing plate 40 and on the side closer to the nozzle plates 32.

In other words, addition or non-addition of the humectant, the viscosity of the ink 12, the number of times of wiping, the length of the wiper 61, the number of wipers 61, the number or arrangement of the nozzle plates 32 on the wiping surface 11, or the speed of the movement of the wiper 61 is arbitrarily selected and is not limited to the configuration of the embodiments described above.

Further, in the embodiments described above, an ink jet type recording apparatus is described as an example of a liquid discharge apparatus; however, the invention is widely applied to a liquid discharge apparatus in general, as a target, and can be also applied to a liquid discharge apparatus including a liquid discharge head that discharges liquids in addition to an ink. Examples of other liquid discharge heads include various recording heads that are used in an image recording apparatus such as a printer, a color material discharge head that is used in manufacturing a color filter of a liquid crystal display or the like, an electrode material discharge head that is used in forming electrodes of an organic EL display, a field emission display (FED), or the like, a bioorganic material discharge head that is used in manufacturing a biochip, and the invention can be applied to a liquid discharge apparatus including the liquid discharge head.

Further, the invention can be widely applied to the liquid ejecting apparatus in general that includes a liquid ejecting head. The invention can be applied to a wiping process in recording heads such as various ink jet type recording heads that are used in an image recording apparatus such as a printer, a color material ejecting head that is used in manufacturing a color filter of a liquid crystal display or the like, an electrode material ejecting head that is used in forming electrodes of an organic EL display, a field emission display (FED), or the like, a bioorganic material ejecting head that is used in manufacturing a biochip.

What is claimed is:

1. A liquid discharge apparatus comprising:

a wiper;

a wiping surface configured to be wiped with the wiper;

a plurality of nozzles provided in the wiping surface;

a drive element for discharging liquids from the nozzles; and a moving mechanism configured to cause the wiper and the wiping surface to relatively move, wherein, in a moving direction of the wiper with respect to the wiping surface, a distance between an edge of the wiping surface on an upstream side in the moving direction and the nozzle disposed on the most upstream side is shorter than a distance between an edge of the wiping surface on a downstream side in the moving direction and the nozzle disposed on the most downstream side, wherein the wiping surface has a first region in which the nozzles are arranged and a second region in which no nozzles are arranged, wherein the wiper is configured to move with respect to the wiping surface at a slower speed in the second region than in the first region, wherein the wiper is shorter in length in a direction intersecting with the moving direction than a length of the wiping surface in the direction intersecting with the moving direction, and wherein the wiper relatively moves a plurality of times from the edge of the wiping surface on the upstream side to the edge of the wiping surface on the downstream side, for wiping the wiping surface.

2. The liquid discharge apparatus according to claim 1, wherein the liquid contains a humectant, and wherein the wiper is configured to wipe a nozzle that discharges a liquid having a low humectant content rate of the liquids, and then wipe a nozzle that discharges a liquid having a high humectant content rate of the liquids.

3. The liquid discharge apparatus according to claim 1, wherein the wiping surface has a plurality of nozzle plates arranged in a zigzag pattern and at positions which are closer to the edge of the wiping surface on the upstream side than the edge on the downstream side, in the moving direction.

4. The liquid discharge apparatus according to claim 1, wherein the wiping surface has a first nozzle plate and a second nozzle plate, and wherein the wiper includes a first wiper for wiping the first nozzle plate and a second wiper for wiping the second nozzle plate.

5. The liquid discharge apparatus according to claim 1, wherein the wiping surface has a first nozzle plate and a second nozzle plate, and wherein the wiper is configured to wipe the first nozzle plate, and then wipe the second nozzle plate.

6. The liquid discharge apparatus according to claim 1, wherein the wiping surface has a nozzle plate group including a first nozzle plate and a second nozzle plate arranged in the moving direction, wherein the nozzle plate group is disposed at a position which is closer to the edge of the wiping surface on the upstream side than the edge on the downstream side, in the moving direction, and wherein the wiper is configured to wipe the nozzle plate group in the moving direction.

7. The liquid discharge apparatus according to claim 1, wherein the wiping surface has a nozzle plate for discharging a liquid having a high viscosity and a nozzle plate for discharging a liquid having a low viscosity, and wherein the wiper is configured to move with respect to the wiping surface at a slower speed on the nozzle plate for discharging the liquid having the high viscosity than on the nozzle plate for discharging the liquid having the low viscosity.

8. The liquid discharge apparatus according to claim 1, wherein the wiping surface is configured with a nozzle plate and a fixing plate.

9. A method for wiping a liquid discharge head that includes:

a wiper, a wiping surface configured to be wiped with the wiper, a plurality of nozzles provided in the wiping surface, a drive element for discharging a liquid from the nozzles, a moving mechanism configured to cause the wiper and the wiping surface to relatively move, and a nozzle region which is interposed between edges of the wiping surfaces and in which the nozzles are arranged, wherein the wiping surface has a first region in which the nozzles are arranged and a second region in which no nozzles are arranged, and the method comprises:

causing the wiper to relatively move in a direction from an edge of the wiping surface which is closer to the nozzle region toward an edge of the wiping surface which is apart from the nozzle region, and wiping the wiping surface;

controlling a rate at which the wiper moves relative to the wiping surface such that the wiper moves at a slower speed in the second region than in the first region;

wherein the wiper is shorter in length in a direction intersecting with the moving direction than a length of the wiping surface in the direction intersecting with the moving direction, and moving the wiper a plurality of times from the edge of the wiping surface on the upstream side to the edge of the wiping surface on the downstream side to wipe the wiping surface.

* * * * *